US009223278B2

(12) United States Patent
Fujiwara et al.

(10) Patent No.: US 9,223,278 B2
(45) Date of Patent: Dec. 29, 2015

(54) IMAGE FORMING APPARATUS THAT PERFORMS GRADATION CORRECTION

(71) Applicant: CANON KABUSHIKI KAISHA, Tokyo (JP)

(72) Inventors: Motohiro Fujiwara, Haar (DE); Sumito Tanaka, Tokyo (JP)

(73) Assignee: CANON KABUSHIKI KAISHA (JP)

( * ) Notice: Subject to any disclaimer, the term of this patent is extended or adjusted under 35 U.S.C. 154(b) by 34 days.

(21) Appl. No.: 14/199,353

(22) Filed: Mar. 6, 2014

(65) Prior Publication Data

US 2014/0255052 A1 Sep. 11, 2014

(30) Foreign Application Priority Data

Mar. 6, 2013 (JP) ..... 2013-044711
Mar. 6, 2013 (JP) ..... 2013-044712

(51) Int. Cl.
*G03G 15/00* (2006.01)
*G03G 15/08* (2006.01)

(52) U.S. Cl.
CPC ..... *G03G 15/5058* (2013.01); *G03G 15/5041* (2013.01); *G03G 15/0829* (2013.01)

(58) Field of Classification Search
CPC ..... G03G 15/0824; G03G 15/0829; G03G 15/5041; G03G 15/5058; G03G 15/5062
See application file for complete search history.

(56) References Cited

U.S. PATENT DOCUMENTS 8,611,768 B2 12/2013 Kubo et al.
2011/0164888 A1* 7/2011 Kubo et al. ..... 399/27
2011/0279835 A1* 11/2011 Tanaka ..... 358/1.9
2012/0183315 A1* 7/2012 Fujiwara ..... 399/49

FOREIGN PATENT DOCUMENTS

JP 2007219089 A 8/2007
JP 2010102317 A 5/2010

* cited by examiner

*Primary Examiner* — David Gray
*Assistant Examiner* — Laura Roth
(74) *Attorney, Agent, or Firm* — Rossi, Kimms & McDowell LLP

(57) ABSTRACT

An image forming apparatus according to an embodiment of the present invention performs, at a predetermined timing, first gradation correction including forming a patch image on an image carrier, and correcting gradation characteristics of a formed image using a correction amount corresponding to the result of measurement of the patch image. The image forming apparatus further performs, at a predetermined frequency, second gradation correction including correcting the light power of laser light output from an exposure apparatus based on the result of detection or estimation of the charge amount of toner used in image formation, and correcting gradation characteristics using a correction amount corresponding to the result of the detection or estimation of the toner charge amount.

9 Claims, 17 Drawing Sheets

IMAGE FORMING APPARATUS THAT PERFORMS GRADATION CORRECTION

BACKGROUND OF THE INVENTION

1. Field of the Invention

The present invention relates to electrophotographic image forming apparatuses, and more particularly, to techniques of reducing variations in density and tint of an image.

2. Description of the Related Art

Generally, in electrophotographic image forming apparatuses, optimum image formation conditions depend on changes over time in components such as the photosensitive member, the development unit, etc., and environmental conditions (temperature and humidity) during image formation. Therefore, in such image forming apparatuses, variations in density and tint of a formed image are, for example, reduced by the following known technique: a test pattern image (patch image) of each color is formed on the photosensitive drum or the intermediate transfer member, and based on the result of measurement of the density, the image formation conditions are controlled to achieve the reduction. This technique enables the image forming apparatus to maintain a stable or consistent quality of image formation.

However, it takes time to perform such a control (image formation stabilizing control). For example, if the control is performed every time image formation has been performed on a predetermined number of sheets, a print job being executed may be interrupted. For example, if the image formation stabilizing control is performed in the middle of continuous image formation (printing) of a large quantity of recording materials, the period of time during which the image formation stabilizing control is performed is a dead time to the user. On the other hand, if the frequency of the image formation stabilizing control is reduced, the quality of image formation deteriorates.

To address such a problem, Japanese Patent Laid-Open No. 2007-219089 proposes a technique of stabilizing an image density by performing, during image formation, an image formation stabilizing control based on an estimation process without forming a test patch. Japanese Patent Laid-Open No. 2010-102317 proposes a feedforward control technique of stabilizing an image density by estimating the charge amount of toner particles based on an estimation model and controlling image formation conditions, such as a contrast potential or gradation conversion conditions during image formation, to suppress the fluctuation in the density of an output image in real time.

However, when the control such as in Japanese Patent Laid-Open No. 2007-219089 supra or Japanese Patent Laid-Open No. 2010-102317 supra is performed, ideal density characteristics can be achieved in a target density region, but an error may occur in a control (correction) of the density characteristics in the other density regions. For example, in Japanese Patent Laid-Open No. 2007-219089 supra, development contrast is corrected based on changes in temperature and humidity in the image forming apparatus or changes in the charge amount of toner in the development apparatus, but even if the density characteristics are corrected in a portion of all density regions, such as a high density region etc., the other density regions are not necessarily able to be corrected.

In Japanese Patent Laid-Open No. 2010-102317 supra, the toner concentration or the toner charge amount is estimated, and based on the result of the estimation, a look-up table (LUT) corresponding to a gradation correction table is corrected to correct the density characteristics of all density regions. However, a change in an image which is determined by the toner concentration or the toner charge amount highly contributes to a high density region, and therefore, it is difficult to accurately correct the density characteristics of a low density region based on the result of the estimation.

SUMMARY OF THE INVENTION

With the above problems in mind, the present invention has been made. The present invention provides an image forming apparatus which can perform image formation with stable or consistent density characteristics throughout all density regions while reducing the dead time by reducing the frequency of formation of a patch image for density measurement to the extent possible.

According to one aspect of the present invention, there is provided an image forming apparatus comprising: an image forming unit including an image carrier configured to be charged on a surface thereof, an exposure unit configured to expose the image carrier with laser light based on an image signal to form an electrostatic latent image on the image carrier, and a development unit configured to develop the electrostatic latent image formed on the image carrier using toner; a gradation correction unit configured to perform first gradation correction including forming a patch image on the image carrier using the image forming unit, and correcting gradation characteristics of the image formed by the image forming unit based on a correction amount corresponding to a result of measurement of the patch image; a detection unit configured to detect or estimate a charge amount of toner possessed by the development unit; and a light power correction unit configured to perform light power correction including correcting light power of laser light emitted from the exposure unit, based on a difference between the toner charge amount detected or estimated by the detection unit and a reference value, wherein the gradation correction unit further performs second gradation correction including correcting the gradation characteristics based on a correction amount corresponding to the toner charge amount detected or estimated by the detection unit when the light power correction unit performs the light power correction.

According to the present invention, an image forming apparatus can be provided which can perform image formation with stable or consistent density characteristics throughout all density regions while reducing the dead time by reducing the frequency of formation of a patch image to the extent possible.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

First Embodiment

<Image Forming Apparatus>

Figure 1:
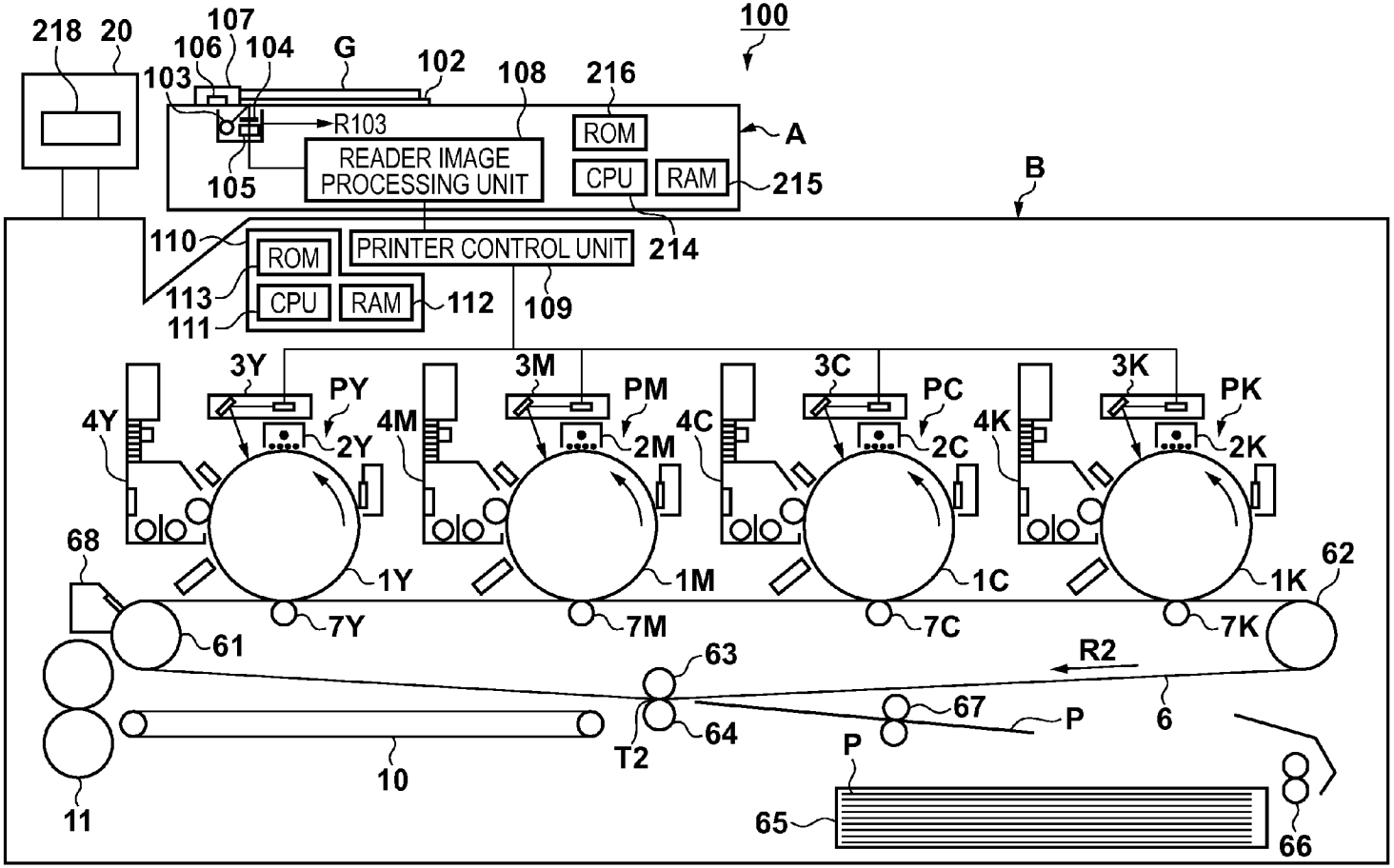
FIG. 1 is a cross-sectional view showing a configuration of an image forming apparatus.

FIG. 1 is a cross-sectional view showing a configuration of an image forming apparatus according to a first embodiment of the present invention. As shown in FIG. 1, the image forming apparatus 100 is a tandem intermediate-transfer full-color printer in which image forming units PY, PM, PC, and PK for forming images of yellow (Y), magenta (M), cyan (C), and black (K), respectively, are provided along an intermediate transfer belt 6.

The image forming units PY, PM, PC, and PK form toner images of the colors Y, M, C, and K on photosensitive drums (image carriers) 1Y, 1M, 1C, and 1K, respectively. The respective color toner images formed on the photosensitive drums 1Y, 1M, 1C, and 1K are transferred to the intermediate transfer belt 6 and superimposed one on top of another (first transfer), so that a four-color toner image is formed on the intermediate transfer belt 6.

The intermediate transfer belt 6 is supported by a tension roller 61, a drive roller 62, and a counter roller 63, spanning over a space between each roller. The intermediate transfer belt 6 is driven by the drive roller 62 to rotate at a predetermined process speed in a direction indicated by an arrow R2 (a circumferential surface of the intermediate transfer belt 6 moves). The four-color toner image transferred to the intermediate transfer belt 6 is transported by the rotation of the intermediate transfer belt 6 to a second transfer unit T2, which then transfers the four-color toner image to a recording material P (second transfer). A fixing apparatus 11 performs a fixing process of applying heat and pressure to the recording material P with the transferred four-color toner image. As a result, the toner image is fixed to a surface of the recording material P. After the fixing process by the fixing apparatus 11, the recording material P is discharged out of the image forming apparatus 100. Thus, a multi-color (full-color) image of toner having the colors Y, M, C, and K is formed on the surface of the recording material P.

When the recording material P stored in a recording material cassette 65 is extracted from the recording material cassette 65, the recording material P is picked up by a separation roller 66, one sheet at a time, and is then transported toward a registration roller 67. The registration roller 67 receives the recording material P in the stopped position and causes the recording material P to wait, and feeds the recording material P into the second transfer unit T2 in accordance with the timing of transfer of a toner image from the intermediate transfer belt 6. A second-transfer roller 64 comes into contact with the intermediate transfer belt 6 supported by the counter roller 63 to form the second transfer unit T2. When a positive direct-current voltage is applied to the second-transfer roller 64, the negatively charged toner image carried by the intermediate transfer belt 6 is transferred onto the recording material P (second transfer).

The image forming units PY, PM, PC, and PK have substantially the same configuration, except that development apparatuses 4Y, 4M, 4C, and 4K use toner having different colors (Y, M, C, and K). When the annexed letters Y, M, C, and K are hereinafter omitted from reference characters, the reference characters indicate substantially identical parts that correspond to the different colors Y, M, C, and K.

Figure 4:
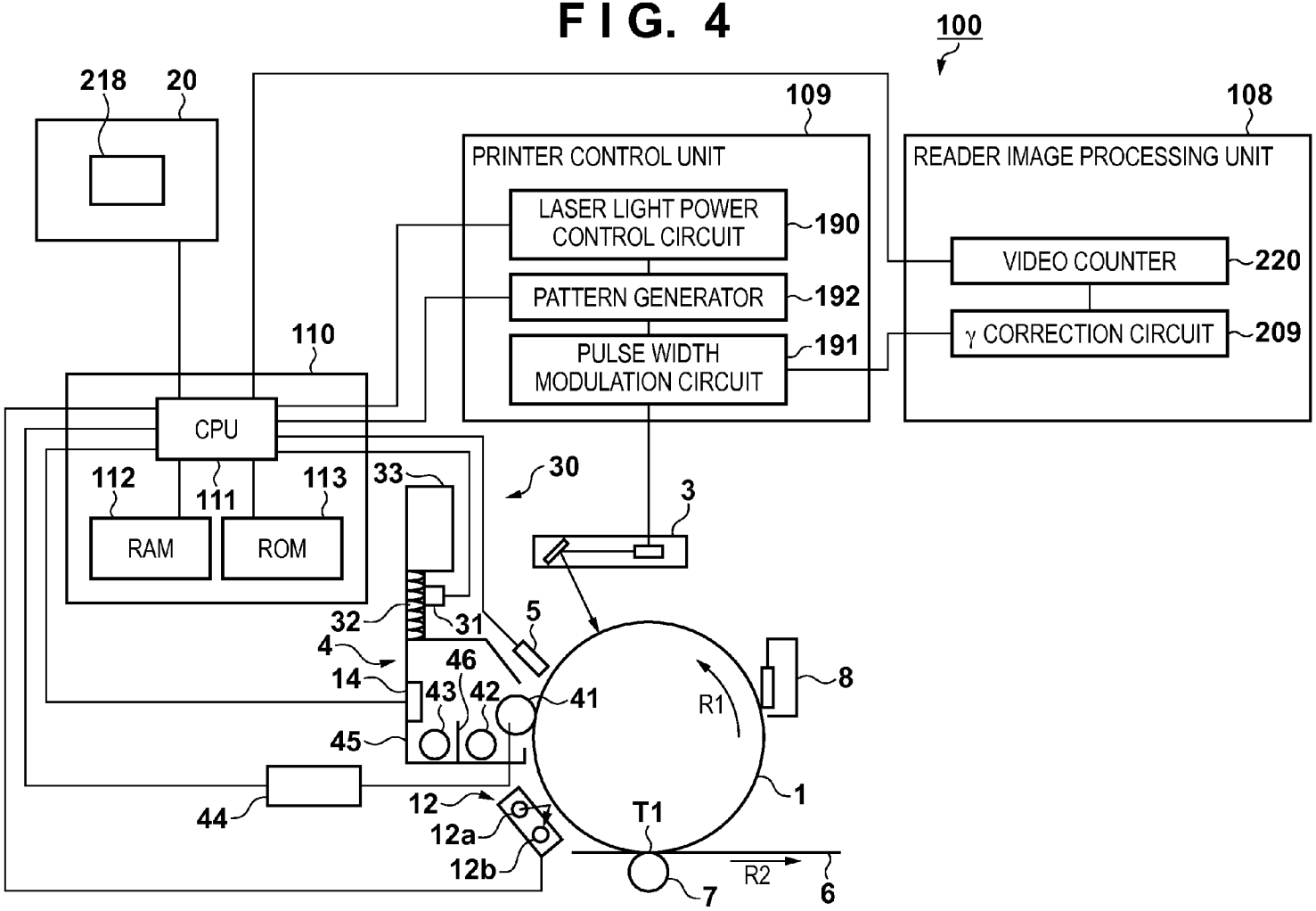
FIG. 4 is a block diagram showing a control system for an image forming unit.

As shown in FIGS. 1 and 4, the image forming unit P includes, around a photosensitive drum 1, a charging apparatus 2, an exposure apparatus 3, a development apparatus 4, a first-transfer roller 7, and a cleaning apparatus 8.

The photosensitive drum 1 has, for example, a photosensitive layer having the negative charge polarity on an outer circumferential surface of an aluminum cylinder thereof. The photosensitive drum 1 rotates at a predetermined process speed in a direction indicated by an arrow R1. For example, the photosensitive drum 1 is an OPC photosensitive member having a reflectance of about 40% with respect to near-infrared light (960 nm).

The charging apparatus 2 includes, for example, a scorotron charger. The charging apparatus 2 irradiates the photosensitive drum 1 with charged particles caused by corona discharge to charge the surface of the photosensitive drum 1 to a uniform negative potential. The exposure apparatus 3 performs scanning with a laser beam using a mirror to form an electrostatic latent image corresponding to a desired image onto the charged surface of the photosensitive drum 1. A potential sensor 5 detects the potential of the electrostatic latent image which has been formed on the photosensitive drum 1 by the exposure apparatus 3.

The development apparatus 4 causes toner to adhere to the electrostatic latent image on the photosensitive drum 1 in order to develop the electrostatic latent image into a toner image. The first-transfer roller 7 presses an inner surface of the intermediate transfer belt 6 to form a first transfer portion T1 between the photosensitive drum 1 and the intermediate transfer belt 6. By applying a positive direct-current voltage to the first-transfer roller 7, the negatively charged toner image carried on the photosensitive drum 1 is transferred to the intermediate transfer belt 6 passing through the first transfer portion T1 (first transfer).

The cleaning apparatus 8 collects, using a cleaning blade, toner which has been left on the photosensitive drum 1 after having passed through the first transfer portion T1 without having been transferred to the intermediate transfer belt 6. A belt cleaning apparatus 68 collects, using a cleaning blade, toner which has been left on the intermediate transfer belt 6 after having passed through the second transfer unit T2 without having been transferred to the recording material P.

The image forming apparatus 100 includes an image reading (reader) unit A, a printer unit B, and a console unit 20 including a display device 218. The console unit 20 is connected to a CPU 214 of the image reading unit A and a control unit 110 (CPU 111) of the printer unit B (the image forming apparatus 100). The user can input via the console unit 20, which functions as an input device, for example, setting information such as the type of an image, the number of sheets, etc. The printer unit B performs image formation based on setting information input via the console unit 20.

<Image Reading Unit>

Figure 2:
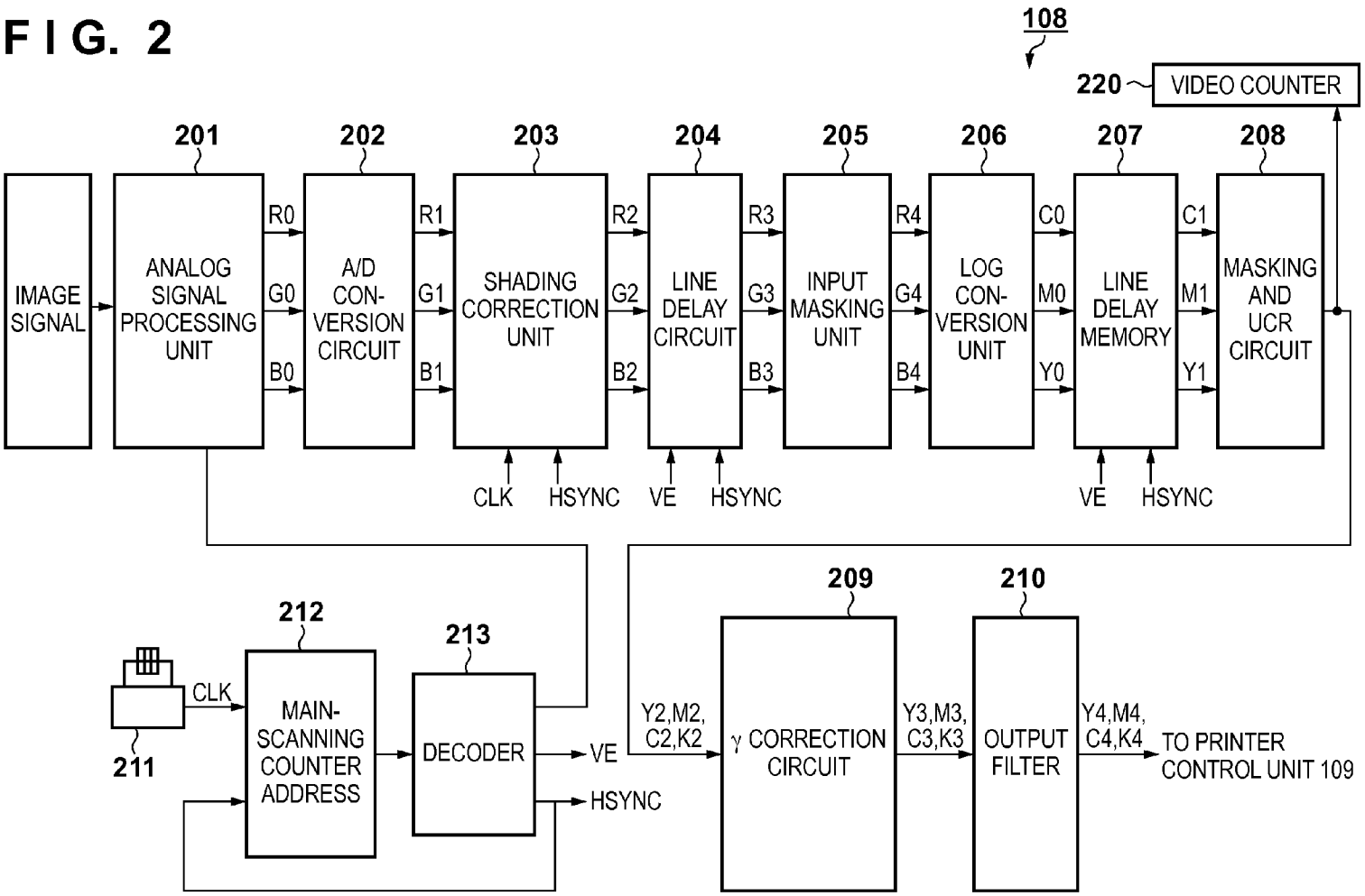
FIG. 2 is a block diagram of signal processing in a reader image processing unit.
Figure 3:
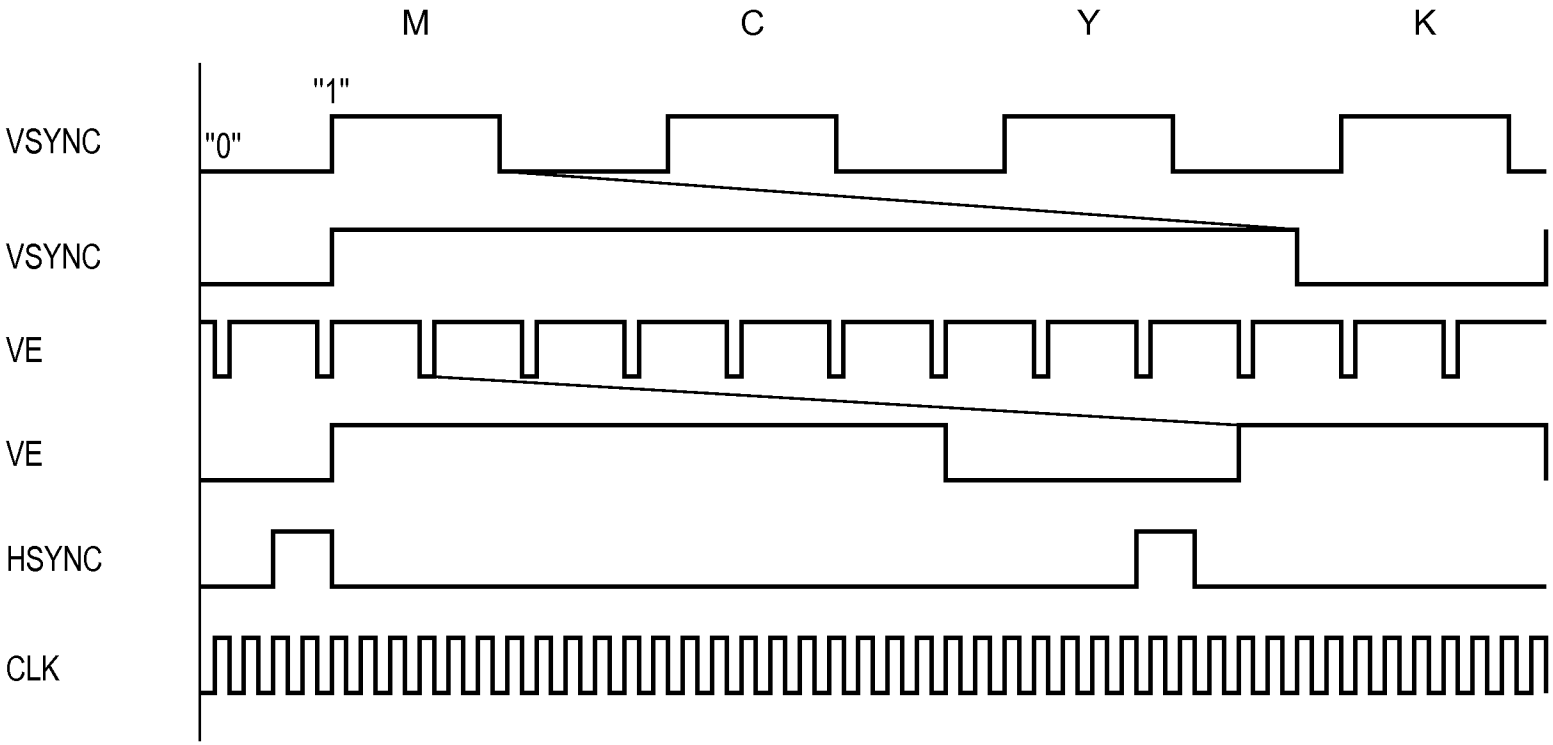
FIG. 3 is a timing chart showing timings of control signals in the reader image processing unit.

FIG. 2 is a block diagram of signal processing in a reader image processing unit 108. FIG. 3 is a timing chart showing timings of control signals in the reader image processing unit 108.

As shown in FIG. 1, a member 107 against which an original document G is caused to abut for positioning is provided on an original document stage glass 102. Also, a reference white plate 106 for determining the white level of a CCD sensor 105 and performing shading correction in the thrust direction of the CCD sensor 105 is provided on the original document stage glass 102.

The image reading unit A reads an image on a face down surface of the original document G placed on the original document stage glass 102. The image of the original document G is illuminated by a light source 103, and is imaged on the CCD sensor 105 via an optical system 104. The CCD sensor 105 includes a CCD line sensor group including three line sensors corresponding to red (R), green (G), and blue (B), which are arranged in three lines, and generate R, G, and B color component signals, respectively. A reader optical system unit including the light source 103, the optical system 104, and the CCD sensor 105 is moved in a direction indicated by an arrow R103 to convert the image of the original document G into an electrical signal data sequence for each line. The reader image processing unit 108 performs image processing on the image signals obtained by the CCD sensor 105, which are then transferred to a printer control unit (printer image processing unit) 109, in which image processing on the image signals is then performed.

As shown in FIG. 2, a clock generating unit 211 generates clocks (CLK signal), one clock for each pixel. A main scan address counter 212 counts clocks generated by the clock generating unit 211 to generate a main scan address for each pixel of one line. The main scan address counter 212 is cleared using an HSYNC signal before starting counting for main scan addresses of the next line. A decoder 213 decodes main scan addresses from the main scan address counter 212 to generate a CCD drive signal, such as a shift pulse, a reset pulse, etc., on a line-by-line basis. The decoder 213 also generates a VE signal indicating an effective region of the one-line read signal of the CCD sensor 105, and a line synchronization signal HSYNC.

As shown in FIG. 3, a VSYNC signal is a signal which indicates an image effective segment in the sub-scanning direction. The reader image processing unit 108 reads (scans) an image in a segment having a logical value of "1" to successively generate output signals corresponding to the colors M, C, Y, and K. The VE signal is a signal which indicates an image effective segment in the main-scanning direction. The reader image processing unit 108 sets the timing of the main scan start position within the segment having a logical value of "1". The VE signal is mainly used for a line count control for line delay. The CLK signal, which is a pixel synchronization signal, is used to transfer image data at the timing when the CLK signal rises from "0" to "1".

As shown in FIG. 2, the image signal output from the CCD sensor 105 is input to an analog signal processing unit 201. Gain adjustment and offset adjustment are performed on the signal input to the analog signal processing unit 201, which is then converted by an A/D conversion circuit 202 into 8-bit digital image signals R1, G1, and B1 for the respective color signals. The digital image signals R1, G1, and B1 are input to a shading correction unit 203, in which shading correction is performed on each color signal based on a signal read from the reference white plate 106.

The R, G, and B line sensors of the CCD sensor 105 are spaced a predetermined distance from each other. Therefore, a line delay circuit 204 corrects spatial non-coincidence in the sub-scanning direction between digital image signals R2, G2, and B2. Specifically, by delaying the R and G signals in the sub-scanning direction on a line-by-line basis relative to the B signal, the R and G signals are caused to coincide with the B signal in the sub-scanning direction. An input masking unit 205 converts a read color space which is determined by the spectral characteristics of R, G, and B filters of the CCD sensor 105 into the standard color space of NTSC by matrix calculation.

A light power/image density converting unit (LOG converter) 206 includes a look-up table (LUT) ROM. As a result, luminance signals R4, G4, and B4 are converted into density signals M0, C0, and Y0 corresponding to image signals M, C, and Y. A line delay memory 207 is used to delay the image signals M0, C0, and Y0 by a line delay until determination signals, such as UCR, FILTER, SEN, etc., which are generated by a black character determining unit (not shown) based on the signals R4, G4, and B4.

A masking and UCR circuit 208 extracts a signal of black K from the input three primary-color signals M1, C1, and Y1, and corrects the color cloudiness of a recording color material in the printer unit B. Thereafter, the masking and UCR circuit 208 sequentially outputs signals M2, C2, Y2, and K2 having a predetermined bit width (8 bits) every reading operation.

A γ correction circuit 209 performs image density correction in order to cause gradation characteristics of the image signals M2, C2, Y2, and K2 in the reader unit A to match ideal gradation characteristics in the printer unit B. The γ correction circuit 209 performs, for example, density conversion using a gamma correction LUT (gradation correction table) implemented by a 256-byte RAM etc. A spatial filter processing unit (output filter) 210 performs an edge reinforcement or smoothing process.

<Exposure Apparatus>

FIG. 4 is a block diagram showing a configuration of a control system for the image forming unit P (PY, PM, PC, and PK). As shown in FIG. 4, the image forming apparatus 100 includes a control unit 110 which performs a centralized control of an image forming operation. The control unit 110 includes a CPU 111, a RAM 112, and a ROM 113.

The exposure apparatus 3 may employ, for example, a laser scanner including a rotating mirror or a resonant mirror. A laser light power control circuit 190 determines the power of exposure light in order to obtain a desired image density level for a laser output signal in the exposure apparatus 3. The exposure apparatus 3 also outputs laser light corresponding to binary laser drive pulses having a pulse width which is determined by a pulse width modulation circuit 191 based on a drive signal generated via the gradation correction table (LUT) of the γ correction circuit 209.

Based on a previously determined relationship between laser output signals and image density levels, a laser output signal which allows for formation of a desired image density is stored as the gradation correction table (LUT) in the γ correction circuit 209. A laser output signal is determined based on the gradation correction table. The frame-sequential image signals M4, C4, Y4, and K4 processed by the spatial filter processing unit 210 are transferred to the printer control unit 109.

The exposure apparatus 3 records an image having a density gradation which is a binary area gradation using pulse width modulation (PWM). Specifically, the pulse width modulation circuit 191 of the printer control unit 109 forms and outputs a laser drive pulse having a width (time width) corresponding to a level of an input image signal (pixel signal) for each pixel. The pulse width modulation circuit 191 forms a drive pulse having a wider width for an image signal for a pixel having a high density, a drive pulse having a narrower width for an image signal for a pixel having a low density, and a drive pulse having an intermediate width for an image signal for a pixel having an intermediate density.

The binary laser drive pulse output from the pulse width modulation circuit 191 is supplied to a semiconductor laser of the exposure apparatus 3. The semiconductor laser emits light for a period of time corresponding to the width of the supplied pulse. Therefore, the semiconductor laser is driven for a longer period of time for a high density pixel and for a shorter period of time for a low density pixel. Therefore, the dot size (area) of an electrostatic latent image formed on the photosensitive drum 1 varies depending on the pixel density. The exposure apparatus 3 performs exposure over a longer range in the main-scanning direction for a high density pixel, and over a shorter range in the main-scanning direction for a low density pixel. Therefore, the amount of toner consumed for a high density pixel is larger than that for a low density pixel.

<Development Apparatus>

The development apparatus 4 employs, for example, a two-component development technique which employs a two-component developing material, which is a mixture of non-magnetic toner and magnetic carrier. The development apparatus 4 mixes a two-component developing material to charge the magnetic carrier to a positive potential and the toner to a negative potential.

In the development apparatus 4, the space of a development container 45 is partitioned into a first chamber (development chamber) and a second chamber (mixture chamber) by a separation wall 46 which extends in a direction perpendicular to plane of the drawing sheet of FIG. 4. A non-magnetic development sleeve 41 is provided in the first chamber, and a magnet is fixed to the inside of the development sleeve 41.

A first screw 42 is provided in the first chamber. The first screw 42 mixes and transports the developing material in the first chamber. A second screw 43 is provided in the second chamber. The second screw 43 transports the developing material in the opposite direction to the transport direction of the first screw 42 while mixing the developing material in the second chamber. The second screw 43 mixes toner which is supplied from a toner supply tank 33 using a rotating toner transport screw 32, with the developing material which has already been in the development apparatus 4, to cause the developing material to have a uniform toner concentration.

The separation wall 46 has a pair of developing material passages through which the first and second chambers are in communication with each other, at end portions thereof which are located closer to and further from the viewer of the drawing sheet of FIG. 4. The transport force of the first and second screws 42 and 43 allows the developing material to circulate in the development container 45 through the pair of developing material passages while being mixed. The developing material in the first chamber whose toner concentration has decreased due to toner consumption by development, is moved through one of the developing material passages to the second chamber. The developing material whose toner concentration has been restored by supply of toner in the second chamber, is moved through the other of the developing material passages to the first chamber.

The two-component developing material in the first chamber is applied by the first screw 42 to the development sleeve 41, and is carried on the development sleeve 41 by the magnetic force of the magnet. The layer thickness of the developing material on the development sleeve 41 is regulated by a layer thickness regulating member (blade), and thereafter, is transferred to a development region facing the photosensitive drum 1 as the development sleeve 41 is rotated by a development sleeve drive apparatus 44. A development bias voltage obtained by superposing an alternating current voltage (vibrating voltage) on a negative direct-current voltage Vdc is applied by a bias power supply 47 to the development sleeve 41. As a result, negatively charged toner is transferred to an electrostatic latent image on the photosensitive drum 1 which is positive relative to the development sleeve 41, so that the electrostatic latent image is reversal-developed.

A developing material supply apparatus 30 includes the toner supply tank 33 storing toner to be supplied, in an upper portion of the development apparatus 4. The toner transport screw 32, which is driven by a motor 31 to rotate is provided below the toner supply tank 33. The toner transport screw 32 supplies the supply toner into the development apparatus 4 through a toner transport path on which the toner transport screw 32 is provided. The CPU 111 of the control unit 110 controls the rotation of the motor 31 via a motor drive circuit (not shown), thereby controlling the supply of toner performed by the toner transport screw 32. The RAM 112, which is connected to the CPU 111, stores control data which is supplied to the motor drive circuit, etc. The toner supply tank 33, the motor 31, the toner transport screw 32, etc., form the developing material supply apparatus 30.

In order to detect a toner concentration (a ratio of the toner to the carrier) of the two-component developing material, a toner concentration sensor 14 is incorporated in the development apparatus 4. The toner concentration sensor 14 is arranged to touch the developing material circulating in the development apparatus 4. The toner concentration sensor 14, which includes a drive coil, a reference coil, and a detection coil, outputs a signal corresponding to the magnetic permeability of the developing material. When a high-frequency bias is applied to the drive coil, the output bias of the detection coil varies depending on the toner concentration of the developing material. By comparing the output bias of the detection coil with the output bias of the reference coil which does not touch the developing material, the toner concentration of the developing material is detected.

The control unit 110 converts the result of the detection performed by the toner concentration sensor 14 into a toner concentration using a conversion expression stored in the ROM 113. The toner concentration T/D of the developing material in the development apparatus 4 is calculated by the CPU 111 based on the result of the measurement performed by the toner concentration sensor 14 according to the following expression:

$$T/D=(\text{SGNL Value}-\text{SGNL}i\text{ Value})/\text{Rate}+\text{Initial } T/D \quad (1)$$

where SGNL Value is a measurement value of the toner concentration sensor 14, SGNLi Value is an initial measurement value (initial value) of the toner concentration sensor 14, and Rate is a sensitivity of the toner concentration sensor 14. Initial T/D and SGNLi Value are measured when the toner supply tank 33 is initially installed. Rate is a previously measured sensitivity to the T/D of ΔSGNL, which is a characteristic of the toner concentration sensor 14. These constants (Initial T/D, SGNLi Value, and Rate) are stored in the RAM 112 of the control unit 110.

<Toner Supply>

In this embodiment, a toner supply amount is calculated by the following technique. In the image forming apparatus 100, the toner concentration of the developing material in the development apparatus 4 decreases due to continuous development of an electrostatic latent image on the photosensitive drum 1. Therefore, the control unit 110 performs a toner supply control to supply toner from the toner supply tank 33 to the development apparatus 4, thereby controlling the toner concentration of the developing material so that it is uniform. As a result, the image density is also controlled so that it is as constant as possible. The image forming apparatus 100 forms an electrostatic latent image on the photosensitive drum 1 using an area gradation technique of producing a gradation based on a difference between toner areas. Therefore, the toner supply operation is performed based on the result of detection of a patch image performed by the image density sensor 12, and is also performed based on a digital image signal for each pixel of an electrostatic latent image formed on the photosensitive drum 1.

The control unit 110 calculates a toner supply amount Msum per sheet for image formation by adding a supply correction amount Mp calculated by a patch detection automatic toner replenisher (ATR) to a basic supply amount Mv calculated by a video count ATR. Note that the term "video count ATR" refers to the technique of calculating the toner supply amount using the fact that the video count value is proportional to the amount of toner consumed. The term "patch detection ATR" refers to the technique of detecting the image density of a patch image and controlling the toner supply amount based on the image density. In this embodiment, the a-posteriori toner shortfall (Mp) detected based on a patch image is added to the toner consumption (Mv) estimated based on image data, whereby the toner supply amount Msum to be supplied to the current development apparatus 4 is determined as follows:

$$\text{toner supply amount } M\text{sum}=Mv+(Mp/\text{frequency of patch detection ATR}) \quad (2)$$

where Mv is the toner supply amount calculated by the video count ATR, and Mp is the toner supply amount calculated by the patch detection ATR.

<Video Count ATR>

The basic supply amount Mv is calculated based on an image signal read by the image reading apparatus (reader) A or an image signal transmitted from a computer etc. A circuit configuration for processing these image signals is shown in the block diagram of FIG. 2.

As shown in FIG. 2, the image signals M2, C2, Y2, and K2 output by the masking and UCR circuit 208 are also transmitted to a video counter 220. The video counter 220 adds up the image density values of pixels to calculate the video count value of each of images of the colors C, M, Y, and K. The video counter 220 processes the image signals M2, C2, Y2, and K2 to add up the density values of pixels. As a result, the video count value of each of the images of the colors C, M, Y, and K is calculated. For example, when a 128-level halftone image having a full A3 size (16.5×11.7 inch) is formed at a resolution of 600 dpi, the video count value is "128×600×600×16.5×11.7=8,895,744,000."

The video count value is converted into the basic supply amount Mv using a table indicating a relationship between video count values and toner supply amounts, which is previously calculated and stored in the ROM 113. Thus, every time image formation has been performed on one sheet, the basic supply amount Mv of the image is calculated.

<Patch Detection ATR>

Figure 5:
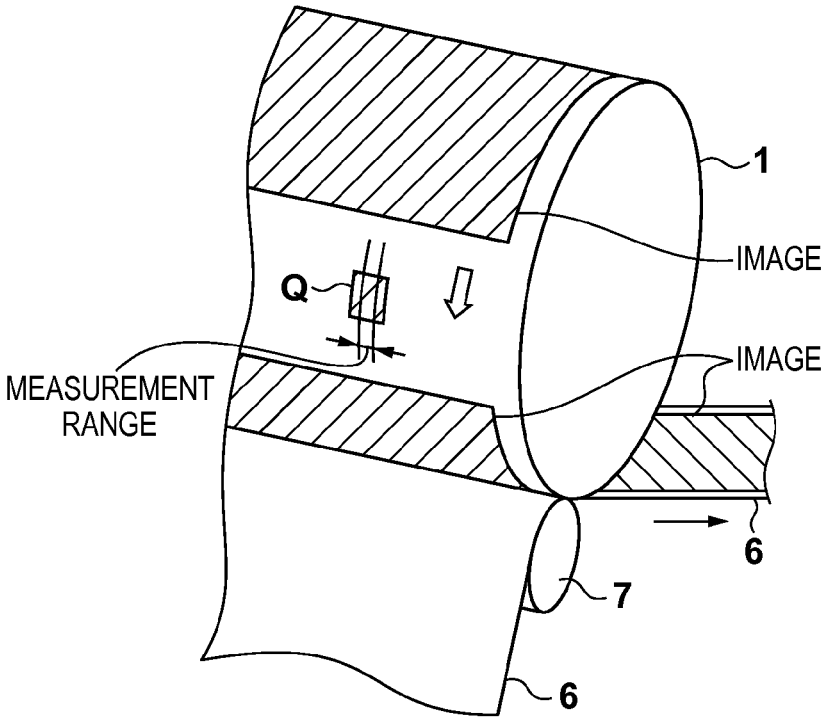
FIG. 5 is a diagram for describing a patch image forming process.

As shown in FIG. 5, the control unit 110 forms a patch image in an image interval (non-image region) which is provided every time image formation has been performed on a predetermined number of sheets, during continuous image formation. For example, the control unit 110 forms a patch image Q which is an image pattern for detecting the image density in a non-image region between a trailing edge of the 24th image and a leading edge of the next image during continuous image formation. Specifically, the control unit 110 controls the exposure apparatus 3 to form, on the photosensitive drum 1, a "patch electrostatic latent image" which is the electrostatic latent image of a patch image, which is developed by the development apparatus 4 to form the patch image Q. The control unit 110 performs a density control by the patch detection ATR. Specifically, based on the result of detection of the patch image Q by the image density sensor 12, the control unit 110 performs a toner supply control to cause the image density of the patch image Q to converge to a reference density.

The printer control unit 109 includes a patch image signal generating circuit (pattern generator) 192 which generates a patch image signal having a signal level corresponding to a predetermined image density. The patch image signal from the pattern generator 192 is supplied to the pulse width modulation circuit 191, which then generates a laser drive pulse having a pulse width corresponding to the predetermined density. The laser drive pulse is supplied to the semiconductor laser of the exposure apparatus 3, which then emits light only for a period of time corresponding to the pulse width to perform exposure and scanning on the photosensitive drum 1. As a result, a patch electrostatic latent image having the predetermined density is formed on the photosensitive drum 1. The patch electrostatic latent image is developed by the development apparatus 4.

As shown in FIG. 4, an image density sensor (patch detection ATR sensor) 12 for detecting the image density of the patch image Q is provided downstream of the development apparatus 4, facing the photosensitive drum 1. The image density sensor 12 includes a light emitting unit 12*a* including a light emitting device such as an LED etc., and a light receiving unit 12*b* including a photodetector such as a photodiode (PD) etc. The light receiving unit 12*b* is configured to detect only specularly reflected light from the photosensitive drum 1. The image density sensor 12 measures the power of the reflected light from the photosensitive drum 1 at the timing when the patch image Q passes below the image density sensor 12. A signal resulting from the measurement is input to the CPU 111.

Figure 6:
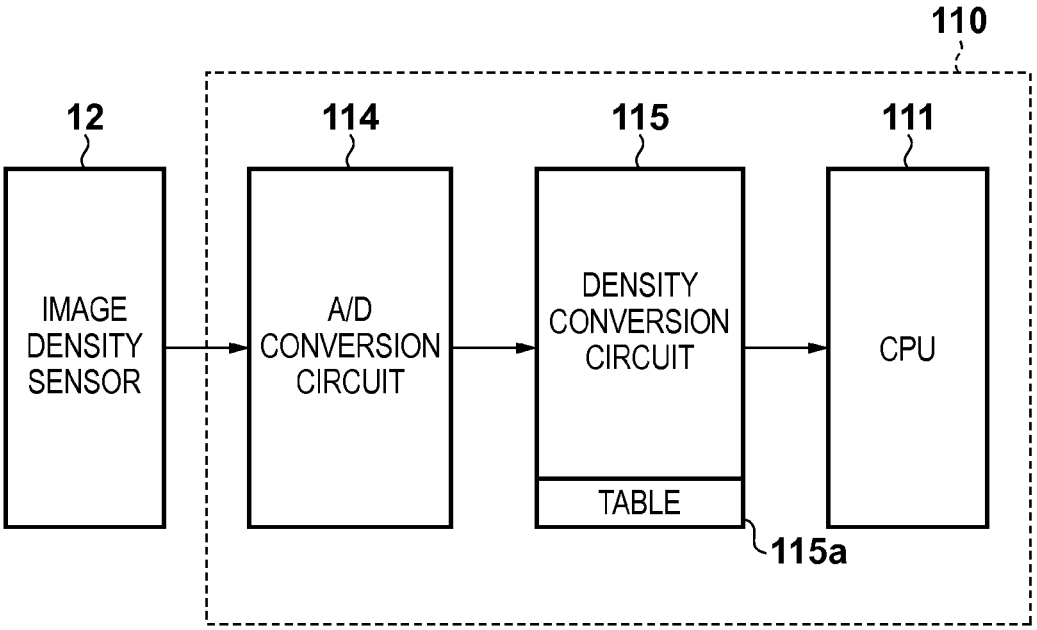
FIG. 6 is a diagram for describing a patch density measuring process.

As shown in FIG. 6, the reflected light (near-infrared light) input from the photosensitive drum 1 to the image density sensor 12 is converted into an analog electrical signal of 0 to 5 V, which is then input to an A/D conversion circuit 114 provided in the control unit 110. The A/D conversion circuit 114 converts the input analog electrical signal into an 8-bit digital signal, which is then output to a density conversion circuit 115 provided in the control unit 110. The density conversion circuit 115 converts the input digital signal into density information, which is then output.

Figure 7:
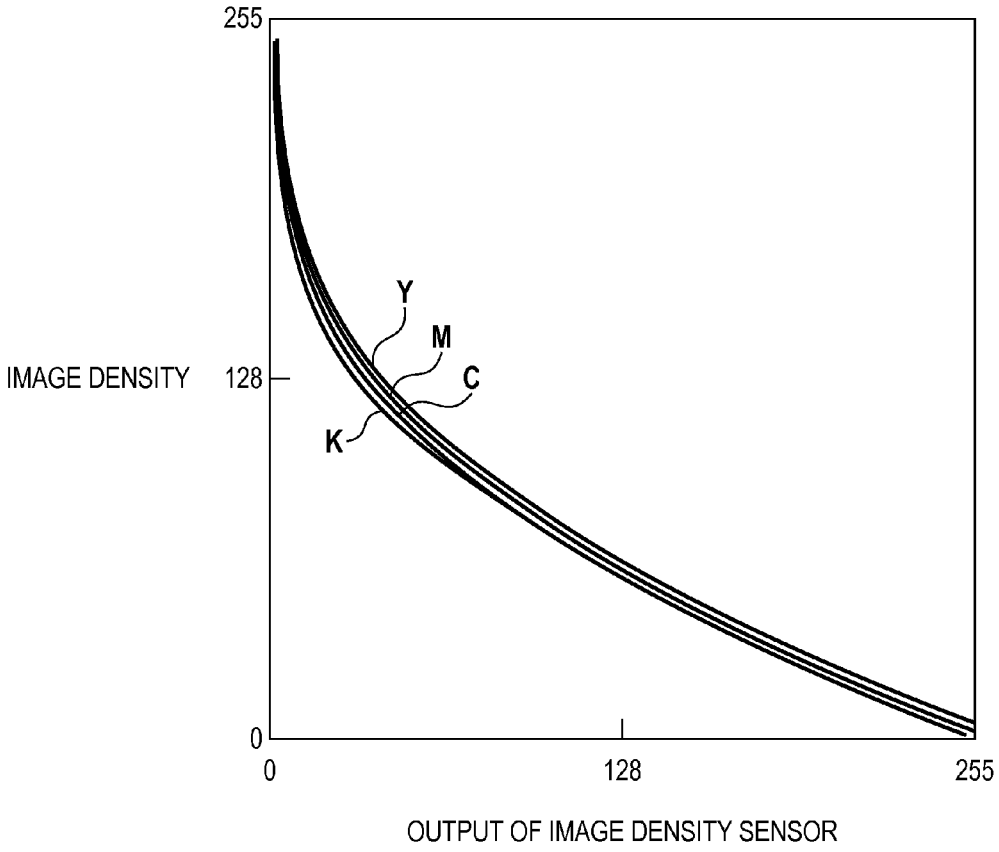
FIG. 7 is a diagram showing a correspondence relationship between image densities and outputs of an image density sensor.

As shown in FIG. 7, when the image density of the patch image Q formed on the photosensitive drum 1 is changed in a stepwise manner by area gradations, the output of the image density sensor 12 changes. Here, it is assumed that the output of the image density sensor 12 is 5 V when toner is not attached to the photosensitive drum 1, and the image density of the patch image Q read by the image density sensor 12 has 255 levels.

As the area covering ratio of toner in a pixel formed on the photosensitive drum 1 increases, the image density also increases. On the other hand, the output of the image density sensor 12 decreases. Based on such characteristics of the image density sensor 12, a table 115*a* specialized for each color which is used to convert the output of the image density sensor 12 into a density signal of the color is previously prepared. The tables 115*a* are stored in a storage unit included in the density conversion circuit 115. As a result, the density conversion circuit 115 can detect the patch image density with high accuracy for all colors. The density conversion circuit 115 outputs the generated density information indicating the patch image density to the CPU 111.

The image density sensor 12 has characteristics represented by a logarithm (log) function, in which as the density increases, the slope of the result of the detection decreases. In other words, as the density increases, a change in the detection result with respect to a change in the density decreases, and as a result, the detection accuracy decreases. Therefore, by reducing the area gradation using a pattern having one space every two lines, the patch image density is reduced. It is assumed that a patch electrostatic latent image which is exposed to light has a resolution of 600 dpi and a pattern of one space every two lines in the sub-scanning direction.

The supply correction amount Mp is calculated from a difference ΔD between the result of the measurement and a reference value which is the detected value of the density of the patch image Q of the initial developing material. For example, a variation ΔDrate is previously calculated for the density measurement result of the patch image Q which is obtained when toner in the development apparatus 4 deviates from the reference value by one gram (reference amount), and is stored in the ROM 113. As a result, the CPU 111 calculates the supply correction amount Mp according to the following expression:

$$Mp=\Delta D/\Delta D\text{rate} \quad (3)$$

Here, the supply of toner corresponding to the supply correction amount Mp is desirably performed in portions which are as equally spaced in time as possible, i.e., the portions of toner are supplied at execution intervals of the patch detection ATR, in order to reduce or avoid steep fluctuation in color. After the patch detection ATR has been performed, if the calculated supply correction amount Mp of toner is supplied all at once during image formation on the first sheet, the significant amount of toner supply may cause overshoot. Therefore, in Expression (3), the supply correction amount Mp is divided by the execution frequency of the patch detection ATR to divide the supply correction amount Mp into equal portions which are supplied at execution intervals of the patch detection ATR.

Thus, the CPU 111 of the control unit 110 calculates the toner supply amount Msum according to Expression (2). The CPU 111 also controls the motor 31 to operate the toner transport screw 32, whereby the toner supply amount Msum of toner is supplied from the toner supply tank 33 to the development container 45.

<Toner Charge Amount>

Figure 8:
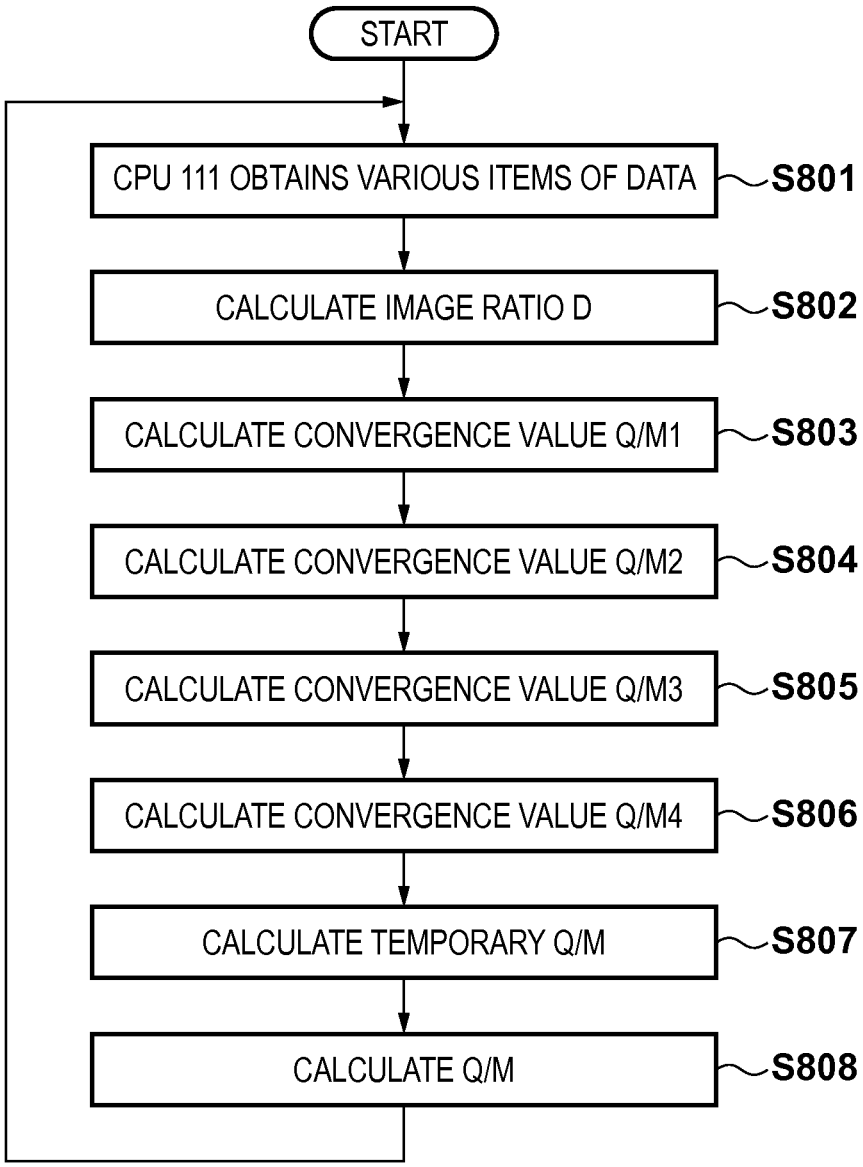
FIG. 8 is a flowchart showing steps of a toner charge amount calculating process.

Next, a technique of estimating a current toner charge amount will be described with reference to FIG. 8. The toner charge amount is calculated by the control unit 110. In the control unit 110, for example, the CPU 111 performs calculation described below using the RAM 112 as a working buffer for the calculation, and a table needed for the calculation, which is stored in the ROM 113, when necessary. As shown in FIG. 8, the calculation of the toner charge amount Q/M (μC/g) is performed at predetermined time intervals. In this embodiment, as an example, the process of calculating the toner charge amount is performed according to the procedure of FIG. 8 every time image formation has been performed on one sheet. Note that the calculation process is not performed when the image forming apparatus 100 is off. In this case, after the image forming apparatus 100 is turned on, the eventual change in the toner charge amount is calculated when image formation is performed on the first sheet.

In step S801, in order to calculate the toner charge amount Q/M for image formation of the n-th sheet, the control unit 110 obtains various items of data, starting from the time of calculating the toner charge amount Q/M for image formation on the (n−1)th sheet. Specifically, the control unit 110 performs a series of processes described as follows.

1) The control unit 110 obtains a video count value for image formation of the n-th sheet from the video counter 220. Because the video count value is considerably large, a value obtained by dividing the video count value by, for example, 2 to the power of 24 may be used as a video count value V for the sake of convenience.

2) The control unit 110 obtains, from the development sleeve drive apparatus 44, a drive time period Td (sec) of the development sleeve 41 between the time of the previous calculation of the toner charge amount Q/M and the current time. The drive time period Td is typically a time difference between the previous image formation (output) and the current image formation (output), including a period of time during which the image forming apparatus 100 is in an off or idle state.

3) The control unit 110 calculates a stop time period Ts (sec) of the development sleeve 41 between the previous image formation and the current image formation.

4) The control unit 110 obtains a toner concentration TDrate (%) from the toner concentration sensor 14.

5) The control unit 110 obtains an absolute moisture amount H (g/kg) in the image forming apparatus which is detected by a temperature-humidity sensor (not shown) attached to the inside of the image forming apparatus 100.

6) The control unit 110 obtains, from the development sleeve drive apparatus 44, a sleeve drive cumulative time period Tt (min) which is obtained by adding up the drive time periods Td (sec) of the development sleeve 41, starting from the timing when the developing material of the development apparatus 4 is replaced.

Next, in step S802, the control unit 110 calculates an image ratio D (%), for example, using the video count value V and the drive time period Td of the development sleeve 41 according to the following expression:

$$\text{image ratio } D = V/Td \times 0.162 \quad (4)$$

As shown in Expression (4), the image ratio D indicates how much image has been formed during the drive time period Td of the development sleeve 41. Note that the coefficient (e.g., 0.162 in Expression (4)) should be optimized for each image forming apparatus. The coefficient 0.162 of Expression (4) is optimum for an image forming apparatus which outputs 70 sheets of an A4-size image per minute. Such optimization allows the average value of the image ratio D per sheet to be equal to the value D calculated according to Expression (4).

Figure 9:
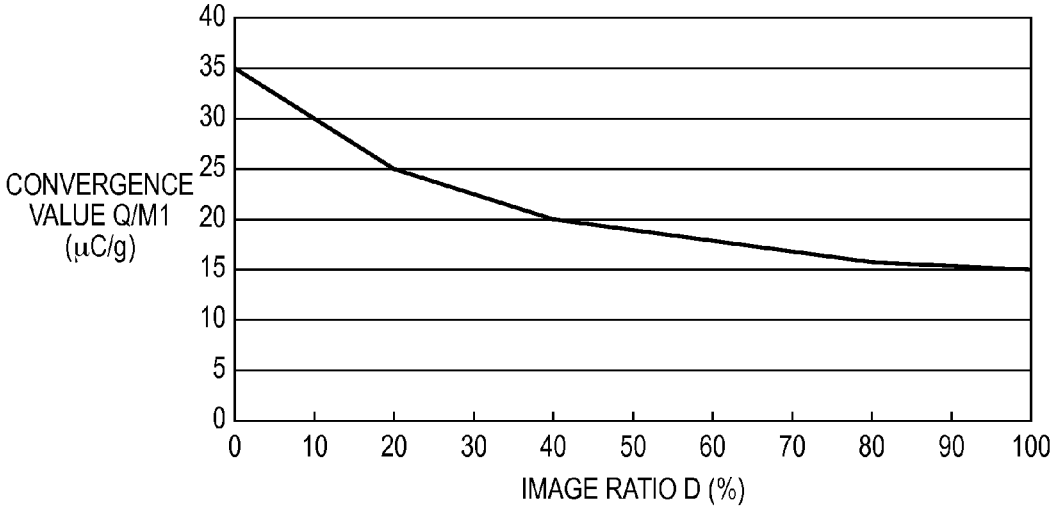
FIG. 9 is a diagram showing a correspondence relationship between image ratios D and convergence values Q/M1, which is used in calculation of the convergence value Q/M1 from the image ratio D.

Next, in step S803, the control unit 110 calculates a convergence value Q/M1 of the toner charge amount Q/M. The convergence value Q/M1 is calculated from the image ratio D using a relationship shown in FIG. 9. The relationship between the image ratio D and the convergence value Q/M1 of FIG. 9 is, for example, previously stored as a table in a memory. The convergence value Q/M1 means a value to which the toner charge amount Q/M converges when image formation is perpetually continued at the image ratio D (%).

Next, in step S804, the control unit 110 calculates a convergence value Q/M2 (μC/g) from the convergence value Q/M1 according to the following expression:

$$\text{convergence value } Q/M2 = \text{convergence value } Q/M1 \times (-0.1 \times TD\text{rate} + 1.8) \quad (5)$$

The convergence value Q/M varies depending on the toner concentration, and therefore, is corrected based on the toner concentration in Expression (5). The relational expression varies among the developing material etc. Therefore, the present invention is not limited to Expression (5). In general, as the toner concentration increases, Q/M tends to decrease, and as the toner concentration decreases, Q/M tends to increase. Note that the coefficients in Expression (5) are also only for illustrative purposes.

Next, in step S805, the control unit 110 calculates a convergence value Q/M3 (μC/g) from the convergence value Q/M2 according to the following expression:

$$\text{convergence value } Q/M3 = \text{convergence value } Q/M2 + 5 - 0.5 \times H \quad (6)$$

The convergence value Q/M also varies depending on the environment, and therefore, is corrected based on the humidity (absolute moisture amount) H in Expression (6). This relational expression varies depending on the components of the developing material etc. Therefore, the present invention is not limited to this expression. In general, as the absolute moisture amount H increases, Q/M tends to decrease, and as the absolute moisture amount H decreases, Q/M tends to increase. Note that the coefficients in Expression (6) are also only for illustrative purposes.

Next, in step S806, the control unit 110 calculates a convergence value Q/M4 (μC/g) from the convergence value Q/M3 according to the following expression:

$$\text{convergence value } Q/M4 = \text{convergence value } Q/M3 \times (-0.000021 \times Tt + 1) \quad (7)$$

The convergence value Q/M varies depending on how much the developing material has deteriorated, and therefore, is corrected based on the sleeve drive cumulative time period Tt in Expression (7). This relational expression also varies depending on the components of the developing material etc. Therefore, the present invention is not limited to this expression. The coefficients in Expression (7) are also only for illustrative purposes.

Next, in step S807, the control unit 110 calculates a temporary Q/M(n) from the convergence value Q/M4 according to the following expression:

$$\text{temporary } Q/M(n) = \alpha \times (\text{convergence value } Q/M4 - Q/M(n-1)) \times Td/60 + Q/M(n-1) \quad (8)$$

Expression (8) is a recurrence relation indicating a change in the toner charge amount when the development sleeve 41 is driven for one minute, i.e., a phenomenon that the toner charge amount gradually approaches the convergence value Q/M. Although it is here assumed that $\alpha=0.01$, $\alpha$ varies depending on the components of the developing material etc. Therefore, the present invention is not limited to this expression. Note that when the temporary Q/M(n) exceeds the convergence value Q/M4, the control unit 110 replaces the temporary Q/M(n) with the convergence value Q/M4.

Finally, in step S808, the control unit 110 calculates the current (current time) Q/M(n) according to the following expression. The toner charge amount Q/M (μC/g) at the current time is calculated according to the following expression:

$$Q/M(n) = -\beta \times Ts/60 \times \text{temporary } Q/M(n) + \text{temporary } Q/M(n) \quad (9)$$

Expression (9) is a recurrence relation indicating a change in the toner charge amount when the development sleeve 41 is at rest, i.e., a phenomenon that electricity charged on toner is gradually discharged, and therefore, the charge amount approaches zero. Although it is here assumed that $\beta=0.001$, $\beta$ varies depending on the components of the developing material etc. Therefore, the present invention is not limited to this expression. Note that when Q/M(n) is lower than ⅓ of the convergence value Q/M4, the control unit 110 replaces Q/M(n) with ⅓ of the convergence value Q/M4. This is in order to define the lower limit value of the toner charge amount, which varies depending on the components of the developing material etc.

Thus, by performing the process of FIG. 8 every time image formation has been performed on one sheet, the toner charge amount Q/M (μC/g) can be calculated for each sheet. The toner charge amount is basically controlled by the above toner supply control to be substantially constant. However, if a change in the toner charge amount, a steep change in the image ratio, a change in the environment, etc., occurs when the image forming apparatus 100 is at rest and therefore the toner supply control cannot be performed, a control which follows a change in the toner charge amount cannot be performed using only the toner supply control. In such a case, the above estimation of the toner charge amount is effective.

<Laser Light Power Correction Control>

Next, a laser light power correction control based on the toner charge amount estimated as described above will be described with reference to FIGS. 4 and 10. In this embodiment, the control unit 110 (CPU 111) controls the laser light power by controlling the laser light power control circuit 190 based on the estimated toner charge amount. Specifically, the control unit 110 controls the laser light power based on a correspondence relationship between toner charge amounts and laser light powers, such as that shown in FIG. 10, using as a reference the toner charge amount which is estimated when the user inputs an instruction to perform density adjustment via the console unit 20. Here, the density adjustment is an operation of adjusting the laser light power and correction characteristics of the γ correction circuit 209 so that a desired density is obtained, based on the densities of patch images for density adjustment which are formed on a recording material by the printer unit B and are read by the reader unit A. By the density adjustment, density characteristics (gradation characteristics) of an image formed on a recording material are adjusted. Note that the density adjustment corresponds to third gradation correction.

Figure 10:
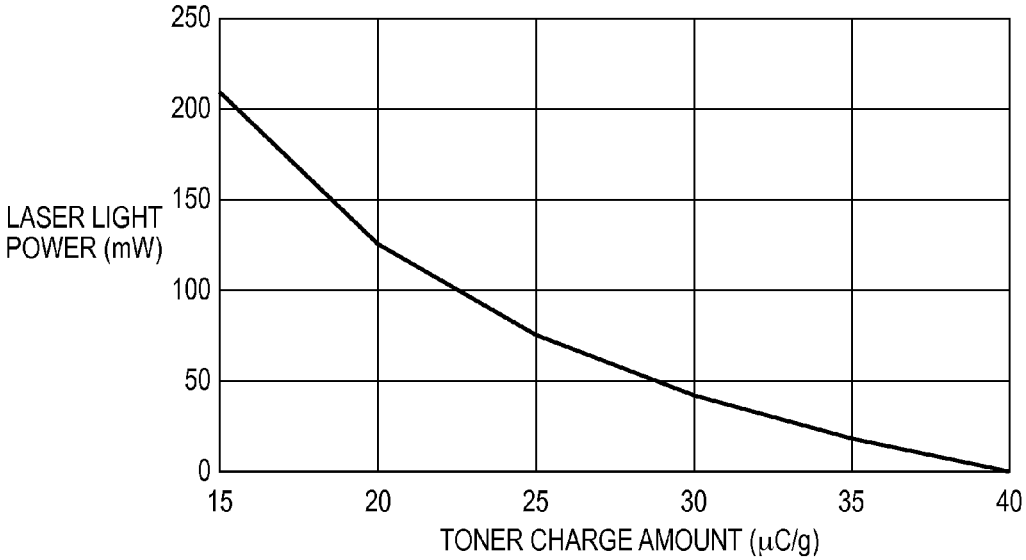
FIG. 10 is a diagram showing a correspondence relationship between toner charge amounts and laser light powers.

FIG. 10 is a diagram showing an example correspondence relationship between toner charge amounts and laser light powers, which is used as a reference for laser light power correction. In this embodiment, the control unit 110 calculates a laser light power which is used as a reference for laser light power correction, from the toner charge amount which is obtained during execution of the density adjustment, based on the correspondence relationship of FIG. 10. For example, when the toner charge amount estimated during execution of the density adjustment is 25 μC/g, the laser light power as the reference is calculated from the correspondence relationship of FIG. 10 to be 75 mW. Thereafter, when the toner charge amount estimated at any arbitrary timing is 20 μC/g, the corresponding laser light power is 125 mW, and therefore, the difference between the laser light power and the reference value is 50 mW. As a result, a correction value by which the laser light power should be corrected is 50 mW. In this case, for example, when the laser light power obtained during execution of the density adjustment is 100 mW, image formation is performed using an output having a laser light power of 150 mW which is obtained by correction with the correction value of 50 mW. Note that the correspondence relationship of FIG. 10 is, for example, assumed to be previously stored as a table in a memory, such as the ROM 113 etc.

<Gradation Correction Control>

In this embodiment, in order to correct the gradation characteristics of an image during normal image formation, a gradation correction control is performed to correct the LUT in the γ correction circuit 209. Specifically, the control unit 110 (CPU 111) forms the patch image Q in a non-image region and detects the density of the patch image Q as in the above patch detection ATR, and based on the result of the detection, corrects the LUT in the γ correction circuit 209.

In this embodiment, as an example, such gradation correction (patch detection LUT correction) based on the detection of the patch image Q is assumed to be performed every time image formation has been performed on a plurality of sheets (e.g., 12 sheets). The table data of the LUT which is used to output laser when the patch image Q is formed, is similar to the table data used for normal image formation at that time, which is the table data which has been corrected by the previous gradation correction control. An image accompanied by halftone formation is used as in normal image formation, instead of an image having a pattern of one space every two lines, which is used in the above patch ATR.

Figure 11:
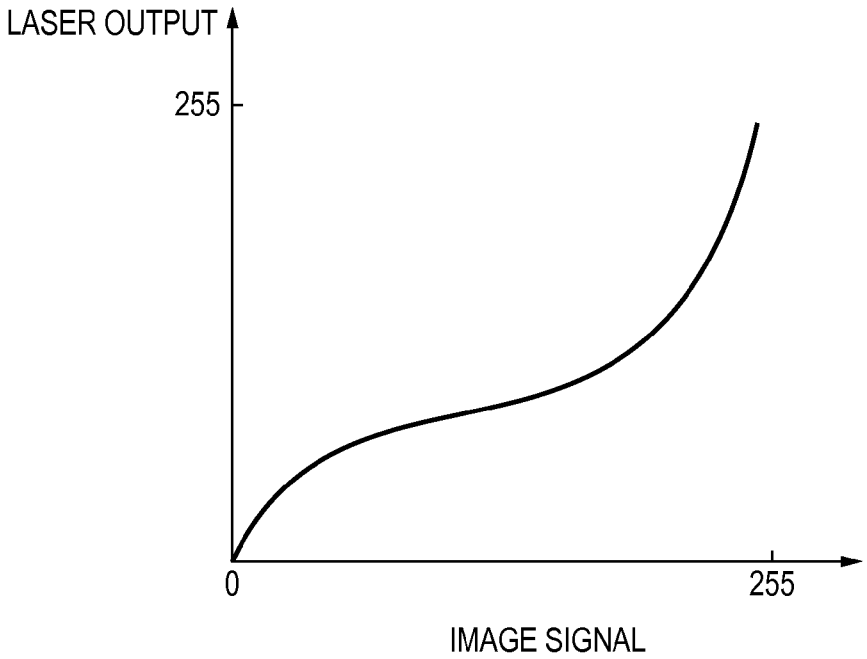
FIG. 11 is a diagram showing example density characteristics (gradation characteristics) corresponding to an LUT for γ correction.

FIG. 11 is a diagram showing example density characteristics (gradation characteristics) corresponding to the LUT in the γ correction circuit 209. In FIG. 11, unlike the above laser light power, a laser output indicates the light emission area (pulse width) of a laser. The maximum value 255 means that the photosensitive drum 1 is exposed to light having a light emission area of 100%.

In this embodiment, the control unit 110 performs the above gradation correction control to correct the LUT possessed by the γ correction circuit 209 as appropriate, thereby controlling the density characteristics of an image formed on a recording material so that they are uniform. For example, the control unit 110 forms on the photosensitive drum 1 the patch image Q for which the input image signal (input density signal) has a value (level) of 64, and corrects the LUT so that the density of the patch image Q on the photosensitive drum 1, which is detected by the image density sensor 12, is 64. In general, the density characteristics of an image formed by the image forming apparatus may vary depending on environmental conditions etc., and therefore, the result of measurement of the density of the patch image Q by the image density sensor 12 may be different from 64. Therefore, the control unit 110 corrects the table data of the LUT based on a difference (shift amount) ΔD between the image signal value of the patch image Q, and the result of density measurement which is performed when the patch image Q is actually formed on the photosensitive drum 1. Note that the shift amount ΔD corresponds to a difference (shift amount) between the density (a target value, here 64) of the previous patch image Q which is obtained from the LUT and the density of the current patch image Q which is obtained from the LUT.

Figure 12:
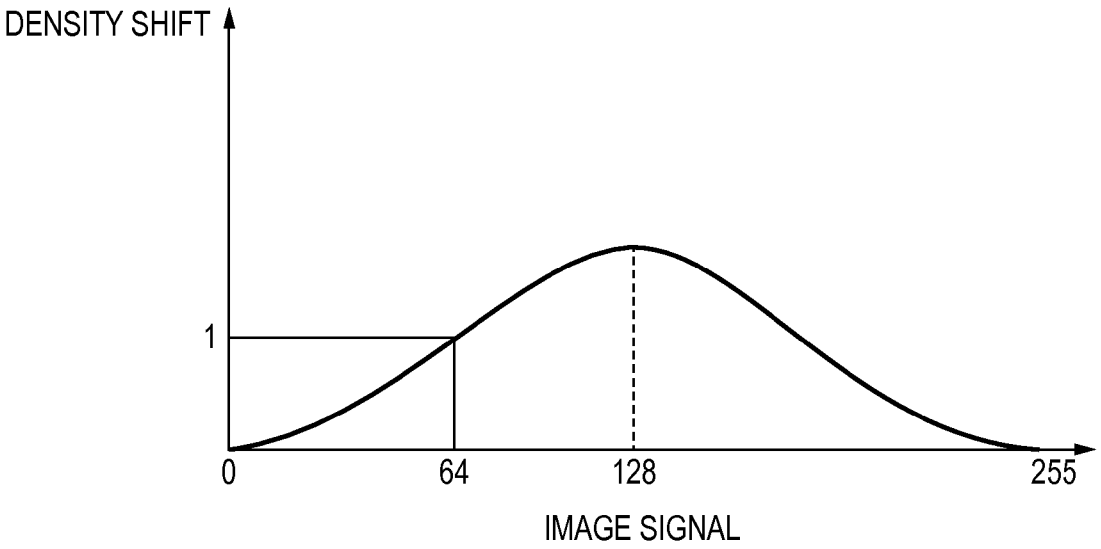
FIG. 12 is a graph showing characteristics of a table (basic LUT correction table) for correcting an image signal, where the shift of the density of a patch image is 1 when the level of the input image signal is 64.

FIG. 12 is a graph showing characteristics of a table (basic LUT correction table) for correcting an image signal, where the shift of the density of the patch image Q is 1 when the level of the input image signal is 64. In this embodiment, the basic correction table is previously stored in the ROM 113. The control unit 110 (CPU 111), when performing the gradation correction control, multiplies, by ΔD, values that each indicate the shift of a density corresponding to a corresponding image signal level, which are contained in the basic LUT correction table stored in the ROM 113, to produce a correction table corresponding to the shift amount ΔD. The control unit 110 also adds the table data of a γ LUT correction table which cancels characteristics (pattern) of the generated correction table, to the table data of the LUT in the γ correction circuit 209, thereby correcting the LUT. Such LUT correction is performed, for each color, at the timing when the production of the correction table corresponding to the shift amount ΔD is completed.

Figure 13:
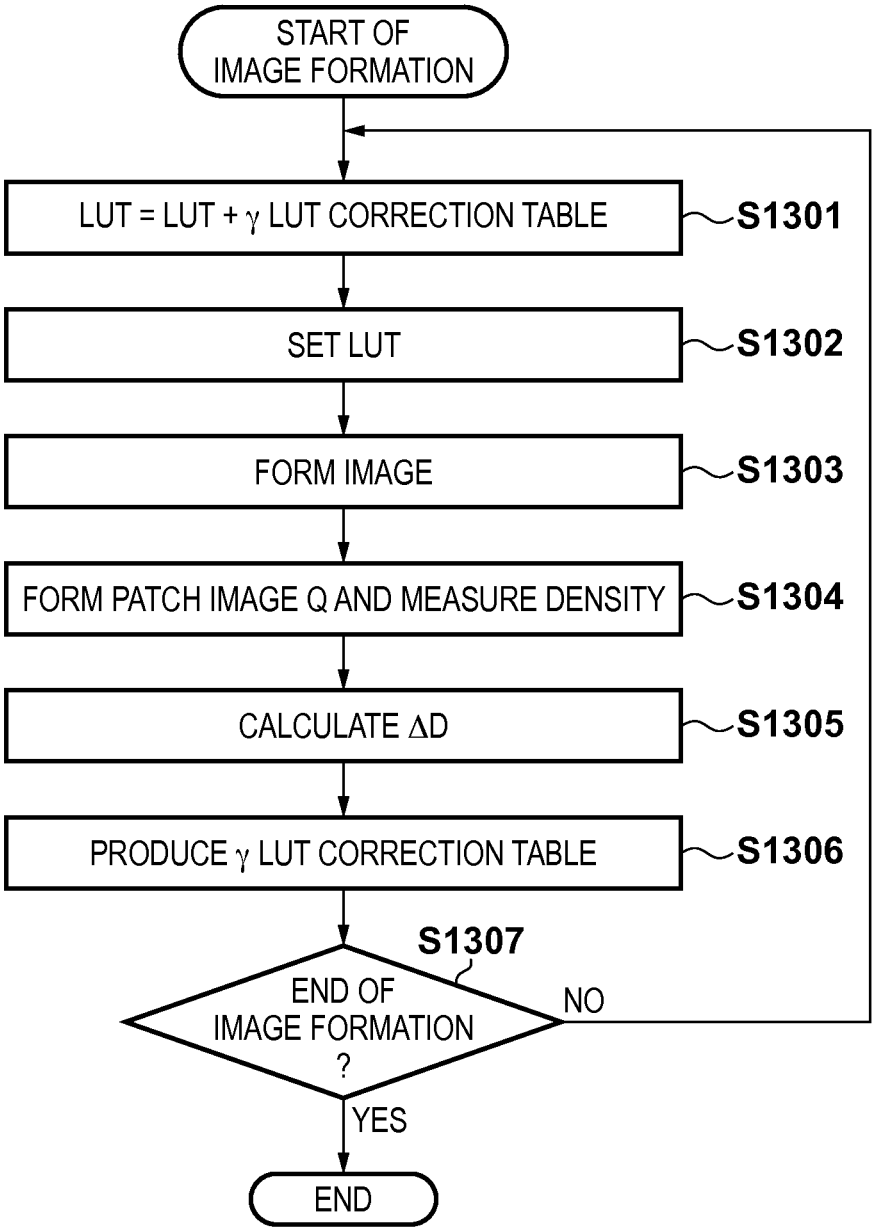
FIG. 13 is a flowchart showing steps of an image forming process including production of an LUT correction table.

FIG. 13 is a flowchart showing steps of an image forming process including production of the LUT correction table. The steps of FIG. 13 are implemented by reading a control program stored in the ROM 113 to the RAM 112 and then executing the control program.

Initially, in step S1301, the CPU 111 corrects the table data of the LUT in the γ correction circuit 209 using the γ LUT correction table obtained by the previous gradation correction control according to Expression (10) below. This correction is achieved by adding, to the table data of the LUT, the table data of a γ LUT correction table which is produced in order to cancel the characteristics of the previous LUT correction table as indicated by the following expression:

$$\text{LUT}=\text{LUT}+\gamma\text{LUT correction table} \tag{10}$$

Moreover, in step S1302, the CPU 111 sets the LUT of the γ correction circuit 209 to have the table data resulting from the correction.

Next, in step S1303, the CPU 111 performs laser output using the LUT thus set to perform image formation. After the end of the image formation, in step S1304 the CPU 111 forms the patch image Q on a non-image region of the photosensitive drum 1 between a trailing edge of the formed image and a leading edge of an image to be next formed, and measures the density of the formed patch image Q using the density sensor 12.

Thereafter, in step S1305, the CPU 111 calculates a difference between the measured density and the target density (=64) as the shift amount ΔD. In step S1306, the CPU 111 produces an LUT correction table using the calculated ΔD and the basic LUT correction table (FIG. 12), and produces a γ LUT correction table which cancels the characteristics of the LUT correction table.

Thereafter, in step S1307, the CPU 111 determines whether or not to continue to perform image formation (print job). If the result of the determination is positive, control returns to step S1301. Otherwise (i.e., image formation is ended), the process is ended.

<Image Forming Process>

The image forming apparatus 100 of this embodiment performs the above laser light power correction control and gradation correction control at predetermined timings in order to stabilize the color and density characteristics (gradation characteristics) of an image when the image is formed on a recording material. In the gradation correction control, basically, as described above, the patch image Q is formed on the photosensitive drum 1 at a predetermined execution frequency (in this embodiment, every time image formation has been performed on 12 sheets), and based on the result of the density measurement, gradation correction (first gradation correction) is performed. In this embodiment, in addition to such gradation correction using the patch image Q, gradation correction (second gradation correction) which employs the above estimation (or detection) result of the toner charge amount is performed at a predetermined frequency. As a result, image formation can be performed with more stable or consistent density characteristics.

Figure 14:
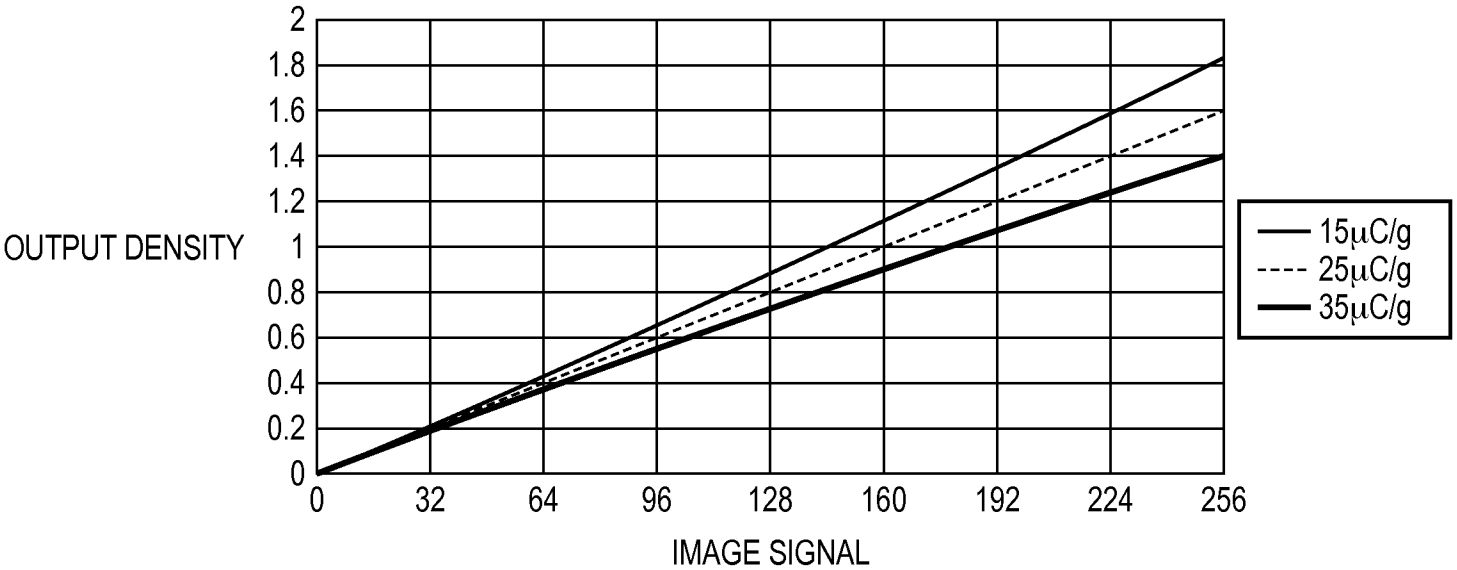
FIG. 14 is a diagram showing an example relationship between input image signals and output densities, where the toner charge amount is used as a parameter.

Here, FIG. 14 is a diagram showing an example relationship between input image signals and output densities (the densities of output images corresponding to respective image signal levels), where the toner charge amount is used as a parameter. As shown in FIG. 14, as the toner charge amount increases, the output density tends to decrease over the entire range. At each image signal level (density region), the output density decreases with a decrease in the toner charge amount. As the image signal level (the density of an input image) increases (higher density region), the decrease in the output density due to the decrease in the toner charge amount becomes more significant. Conversely, as the density of an input image decreases (lower density region), the output density is less influenced by the decrease in the toner charge amount.

The toner charge amount of FIG. 14 is an average value of all toner in the development apparatus 4. However, actually, the charge amount of toner in the development apparatus 4 has a non-uniform distribution, and the charge amount varies among portions of the toner. Therefore, it is considered that, in the development process of the development apparatus 4, a portion of toner having a charge amount more suitable for development (i.e., a portion of toner which more easily adheres to an electrostatic latent image) is first used in development. It is considered that, for development of a low density region, the amount of toner used is not very large, and only a portion of toner having a charge amount suitable for development is used, and therefore, the output density is less influenced by the average toner charge amount. On the other hand, it is considered that, for development of a high density region, a large amount of toner is used, and therefore, the average toner charge amount largely contributes to the output density, so that the output density is more easily influenced by the average toner charge amount.

Therefore, it is considered that it is not desirable to actively perform density correction in a low density region with respect to the above-described variations in the toner charge amount, but it is necessary to perform density correction on a low density region to some extent. It is also considered that the development of a low density region does not depend very much on the average toner charge amount, but depends on the distribution of the toner charge amount. However, it is difficult to estimate the charge amount of each individual toner particle, and therefore, it is difficult to control the density characteristics in a low density region so that they are uniform, only by laser light power correction.

In this embodiment, as described above, in order to stabilize the density characteristics in a low density region of an output image, the patch image Q is actually formed, and the gradation correction control is performed based on the result of measurement of the density. The gradation correction control can correct the density characteristics of an output image to substantially ideal density characteristics, at the timing when the patch image Q is formed and gradation correction is performed. However, when the patch image Q is formed on the photosensitive drum 1, toner consumption increases, it is necessary to provide a non-image region between images, and it is necessary to perform cleaning for removing the patch image Q from the photosensitive drum 1, resulting in a dead time.

In order to reduce such a dead time, in this embodiment, the gradation correction control is performed based on formation of the patch image Q every time image formation has been performed on 12 sheets as described above, and the laser light power correction control is performed at a higher execution frequency.

Figure 15:
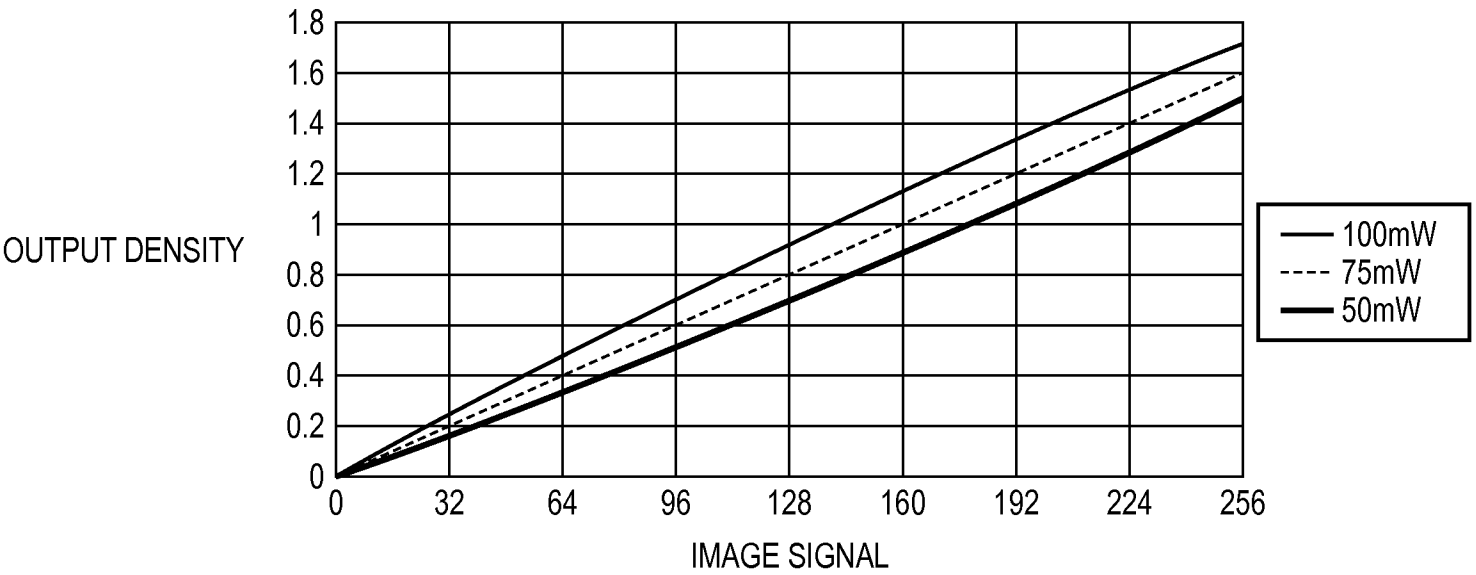
FIG. 15 is a diagram showing an example relationship between input image signals and output densities, where the laser light power is used as a parameter.

Here, FIG. 15 is a diagram showing an example relationship between input image signals and output densities (the densities of output images corresponding to respective image signal levels), where the laser light power is used as a parameter. As shown in FIG. 15, as the laser light power increases, the output density increases over the entire range. However, as opposed to the case of the toner charge amount of FIG. 14, as the image signal level (the density of an input image) decreases (lower density region), the output density is more easily influenced by a change in the laser light power. This is due to the properties of the photosensitive drum 1. In a high density region, the entire beam spot is irradiated with laser beams. On the other hand, in a low density region, laser beams are sparse in a beam spot. It is considered that, in a low density region, a region surrounding the irradiated portion is also influenced by the irradiation with laser beams, and particularly, the influence is high when the laser light power is high. On the other hand, it is considered that, in a high density region, a region surrounding the irradiated portion is also irradiated with laser beams, and therefore, such influence is not likely to occur.

Therefore, if the laser light power is controlled to correct the density characteristics with reference to a high density region based on the result of estimation (detection) of the toner charge amount, excessive correction is performed in a low density region, resulting in an error in correction. In this embodiment, in order to address such a phenomenon, a gradation correction control is performed based on the result of estimation (detection) of the toner charge amount, taking such a correction error into consideration, as follows.

Specifically, ΔD used in the gradation correction control is calculated according to the following relational expression:

$$\Delta D = c \times \Delta\text{toner charge amount} \quad (11)$$

where c is a coefficient which is obtained by a preliminary measurement for each image forming apparatus, and c=3 in this embodiment, and Δtoner charge amount is a difference between the toner charge amount which is estimated at the timing when the patch image Q is most recently formed (i.e., the timing of first gradation correction based on the patch image Q) and the current toner charge amount. In this embodiment, the difference is multiplied by the coefficient c to calculate ΔD, and (second) gradation correction is performed using the calculated ΔD as in the (first) gradation correction performed based on the patch image Q. As a result, for example, by performing a control as if the patch image Q were formed and ΔD were calculated every time image formation has been performed on one sheet, the gradation correction employing the result of estimation of the toner charge amount is performed. Note that, when the patch image Q is actually formed to perform the (first) gradation correction, the Δtoner charge amount is "0" and therefore the gradation correction based on the toner charge amount using Expression (11) is not performed.

A general mechanism of such gradation correction will now be described. As shown in FIG. 14, as the toner charge amount increases, the output density decreases over the entire range, and therefore, in the above laser light power correction control, the laser light power increases. As a result, in a high density region, the ideal density characteristics can be achieved. On the other hand, in a low density region, the increase in the output density due to the increase in the laser light power causes a correction error. Therefore, in this embodiment, a control is performed to detect a high output density based on ΔD calculated according to Expression (11). As a result, in the (second) gradation correction, a γ LUT correction table which cancels the density shift amount ΔD is generated, and therefore, even in a low density region, the density characteristics can be caused to approach the ideal characteristics.

Figure 16:
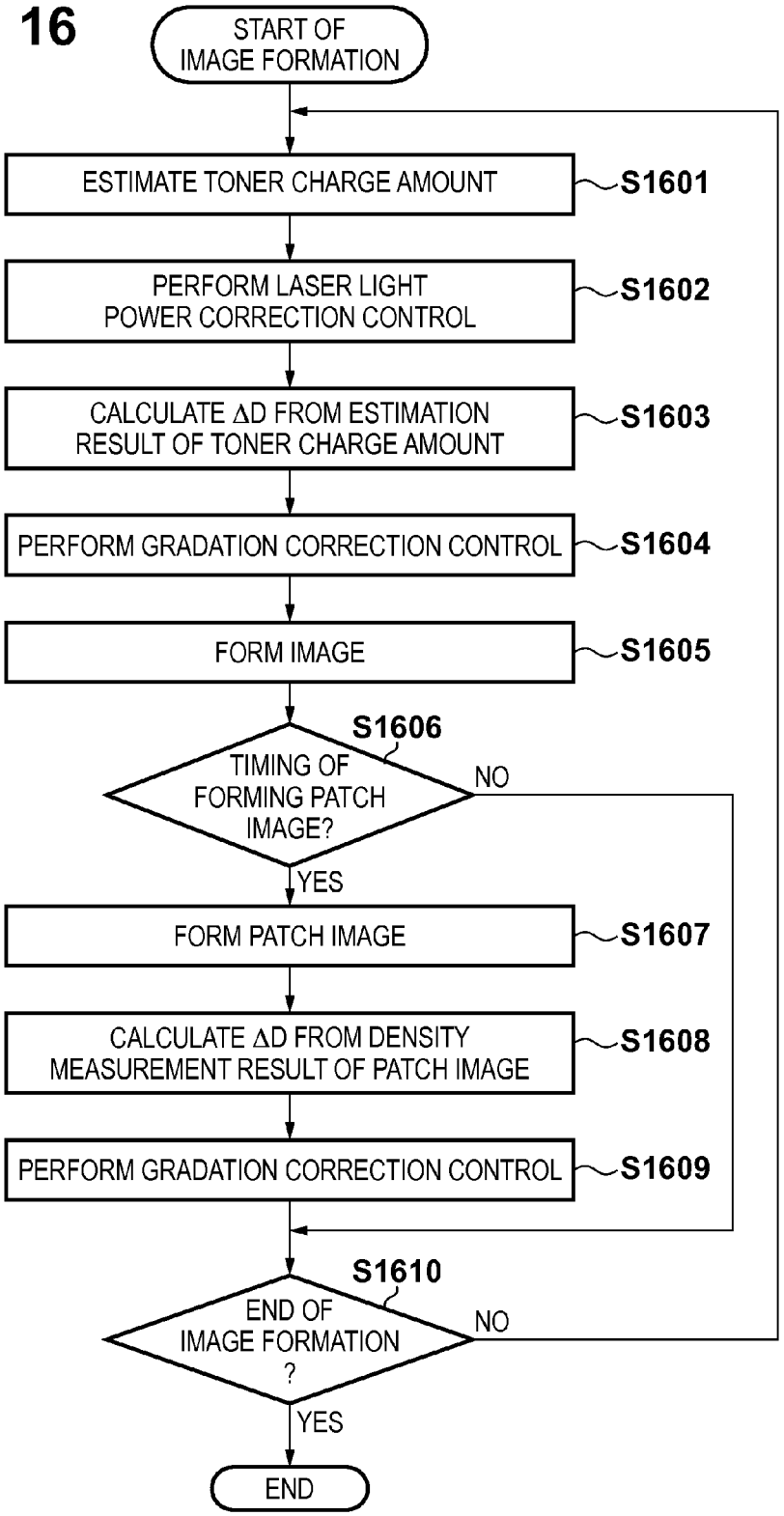
FIG. 16 is a flowchart showing steps of an image forming process including a laser light power correction control and a gradation correction control, in an image forming apparatus according to a first embodiment of the present invention.

Next, steps of an image forming process including the above laser light power correction control and gradation correction control, in the image forming apparatus 100 of this embodiment, will be described with reference to FIG. 16. The steps of FIG. 16 are implemented by reading a control program stored in the ROM 113 to the RAM 112 and then executing the control program.

Initially, when the user inputs an instruction to perform image formation, via the console unit 20, to the CPU 111, the CPU 111 performs processes of step S1601 and following steps. In step S1601, the CPU 111 estimates (or detects) the toner charge amount using the technique described with reference to FIG. 8. In step S1602, based on the result of the estimation, the CPU 111 performs a light power correction control which corrects the light power of laser light output from the exposure apparatus 3. Specifically, as described above with reference to FIG. 10, the light power of laser light is corrected based on a difference between the estimated toner charge amount and a reference value.

Next, in step S1603, the CPU 111 calculates ΔD as a correction amount corresponding to the estimated toner charge amount, according to Expression (11), using the toner charge amount estimated in step S1601. Moreover, in step S1604, the CPU 111 performs gradation correction (second gradation correction) based on the calculated ΔD without forming the patch image Q for density measurement. Note that if steps S1601 to S1604 are performed before the start of execution of image formation, then even when the image forming apparatus 100 has continued to be unused for a long period of time, or a significant change occurs in environmental conditions, the image forming apparatus 100 can perform image formation with more stable or consistent density characteristics.

Next, in step S1605, the CPU 111 causes the image forming unit P to start performing image formation based on an instruction to perform image formation. During execution of image formation, in step S1606 the CPU 111 determines whether or not it is the timing of forming the patch image Q (in this embodiment, this timing occurs every time image formation has been performed on 12 sheets). If the result of the determination is negative, control proceeds to step S1610. Otherwise, control proceeds to step S1607.

In step S1607, the CPU 111 forms the patch image Q for density measurement on the photosensitive drum 1. In step S1608, based on the result of the measurement of the density of the patch image Q, the CPU 111 calculates ΔD as a correction amount corresponding to the result of the measurement of the density of the patch image Q. In step S1609, the CPU 111 performs gradation correction (first gradation correction) based on the calculated ΔD. Moreover, in step S1610, the CPU 111 determines whether or not to end the image formation. If the result of the determination is negative, control returns to step S1601.

Figure 17:
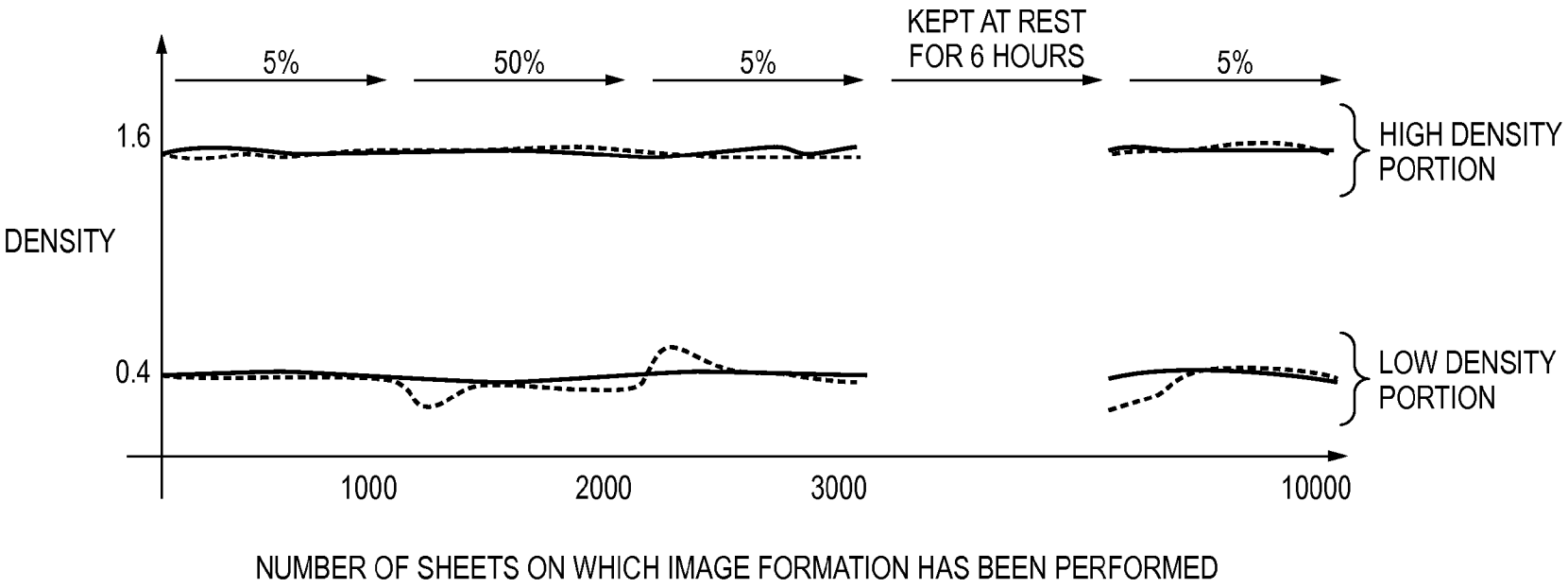
FIG. 17 is a diagram showing example changes in density characteristics with respect to the number of sheets on which image formation has been performed, in an image forming apparatus according to an embodiment of the present invention.
Figure 18:
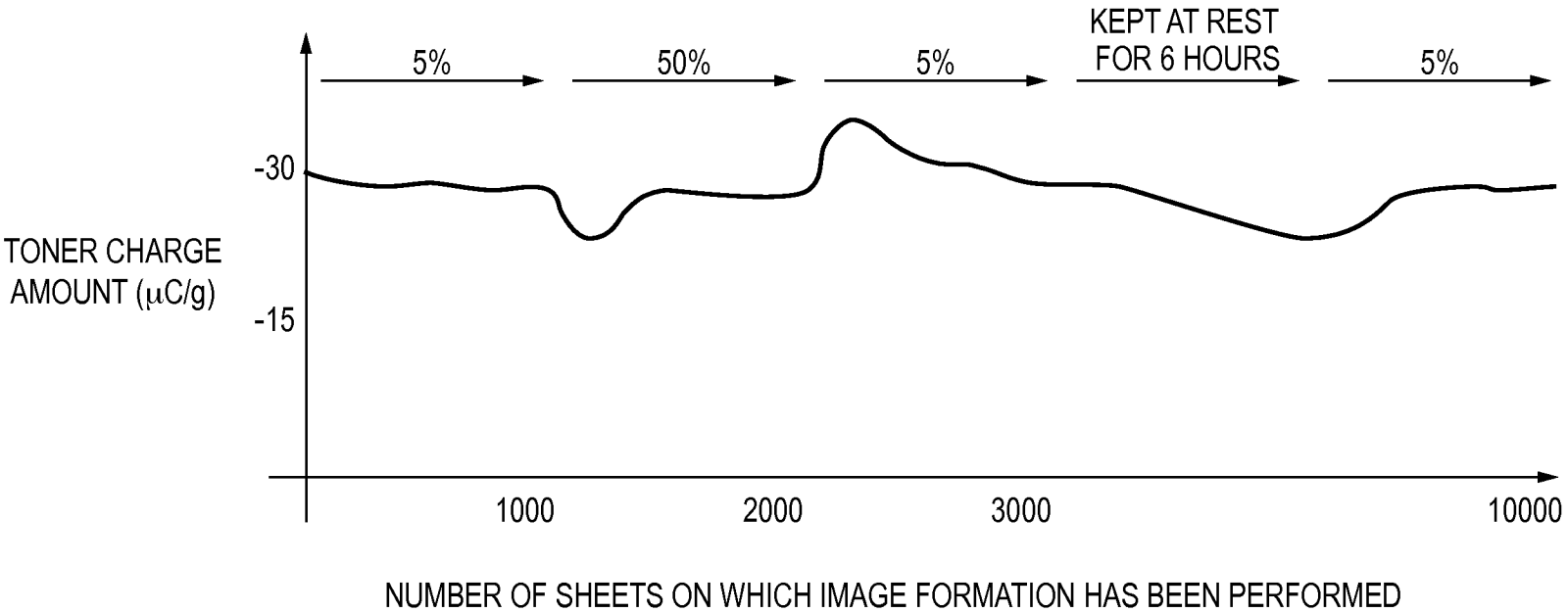
FIG. 18 is a diagram showing example changes in the toner charge amount with respect to the number of sheets on which image formation has been performed, in an image forming apparatus according to an embodiment of the present invention.

Next, FIG. 17 shows example changes in the density characteristics with respect to the number of sheets on which image formation has been performed, when the result of estimation of the toner charge amount is used in the laser light power correction control and the gradation correction control (solid lines), and when the result of estimation of the toner charge amount is used only in the laser light power correction control (dashed lines). FIG. 18 shows example changes in the toner charge amount with respect to the number of sheets on which image formation has been performed, in the above two cases. FIGS. 17 and 18 show characteristics under the following circumstances.

An image is continuously formed on 1,000 A4-size sheets of recording material at an image ratio of 5%.

Next, an image is formed on 1,000 sheets of recording material at an image ratio of 50%.

Next, the image forming apparatus 100 is kept at rest for 6 hours, and then, an image is formed on 1,000 sheets of recording material at an image ratio of 5%.

As shown in FIGS. 17 and 18, by using the result of estimation of the toner charge amount in both the laser light power correction control and the gradation correction control as in this embodiment, stable or consistent density characteristics can be obtained. Specifically, when the image ratio is switched from 5% to 50%, the toner charge amount decreases due to the shortage of the toner charge amount caused by an increase in toner consumption, until the toner charge amount is corrected by the patch detection ATR. However, the laser light power is corrected by the laser light power correction control, depending on the toner charge amount, and therefore, density characteristics are stabilized in a high density portion (high density region). Note that, although not shown, when such a laser light power correction control is not performed, the density characteristics of the high density portion are not stable or consistent. On the other hand, in a low density portion (low density region), when only the laser light power correction control is performed (dashed lines), density characteristics vary depending on a change in the toner charge amount. The same applies to a case where the image ratio is switched from 50% to 5%. The same substantially applies to a case where the image forming apparatus is kept at rest and therefore the toner charge amount decreases.

In contrast to this, as shown in FIGS. 17 and 18, in this embodiment, both in a high density region and a low density region (i.e., irrespective of density), image formation can be performed with stable or consistent density characteristics even when circumstances change as described above.

As described above, the image forming apparatus 100 of this embodiment can stabilize the density characteristics of a low density region by the (first) gradation correction based on formation of a patch image. The image forming apparatus 100 of this embodiment can also stabilize the density characteristics of a low density region by the (second) gradation correction based on the result of estimation of the toner charge amount, even during a period of time during which the gradation correction based on formation of a patch image is not performed. Specifically, in this embodiment, the image forming apparatus 100 can perform image formation with stable or consistent density characteristics irrespective of the level (density) of an input image signal, thereby forming a higher quality image.

Second Embodiment

As in the first embodiment, by sequentially performing the (second) gradation correction based on the estimation of the toner charge amount, the density characteristics of halftone density can be corrected, and therefore, the difference between the density of a formed image which has been corrected by the gradation correction control, and the actual density of the patch image Q, can be controlled so that it is ideally zero. However, an error is likely to occur in the difference between the density of a formed image which has been corrected by the gradation correction control, and the actual density of the patch image Q, due to an error in the estimation of the toner charge amount, variations in distribution of the toner charge amount, or variations in density characteristics due to a factor other than the toner charge amount.

Therefore, as a feature of the second embodiment, when the gradation correction based on the result of estimation of the toner charge amount is performed, gradation characteristics are corrected based on a correction amount which is obtained by modifying a correction amount corresponding to the estimated toner charge amount using a modification coefficient described below. As a result, the difference between the density of a formed image which has been corrected by the gradation correction control, and the actual density of the patch image Q, is reduced to the extent possible, and therefore, image formation can be performed with more stable or consistent density characteristics compared to the first embodiment. Note that, in the description that follows, parts corresponding to those of the first embodiment will not be described for the sake of simplicity.

Specifically, in this embodiment, Expression (11) for calculating ΔD is changed to the following expression:

$$\Delta D = J \times c \times \Delta\text{toner charge amount} \quad (12)$$

where J is a control ratio to a correction amount by the gradation correction control based on the result of estimation of the toner charge amount. In this embodiment, J corresponds to a modification coefficient which is calculated as a ratio of a correction amount corresponding to the result of measurement of the density of a patch image to a correction amount which has been used in the gradation correction most recently performed based on the result of estimation of the toner charge amount, every time the (first) gradation correction based on the patch image Q has been performed. When density adjustment (third gradation correction) is performed by the user's instruction, J is set to a reference value "1" and thereafter is updated every time the patch image Q has been formed by the gradation correction control.

Figure 19:
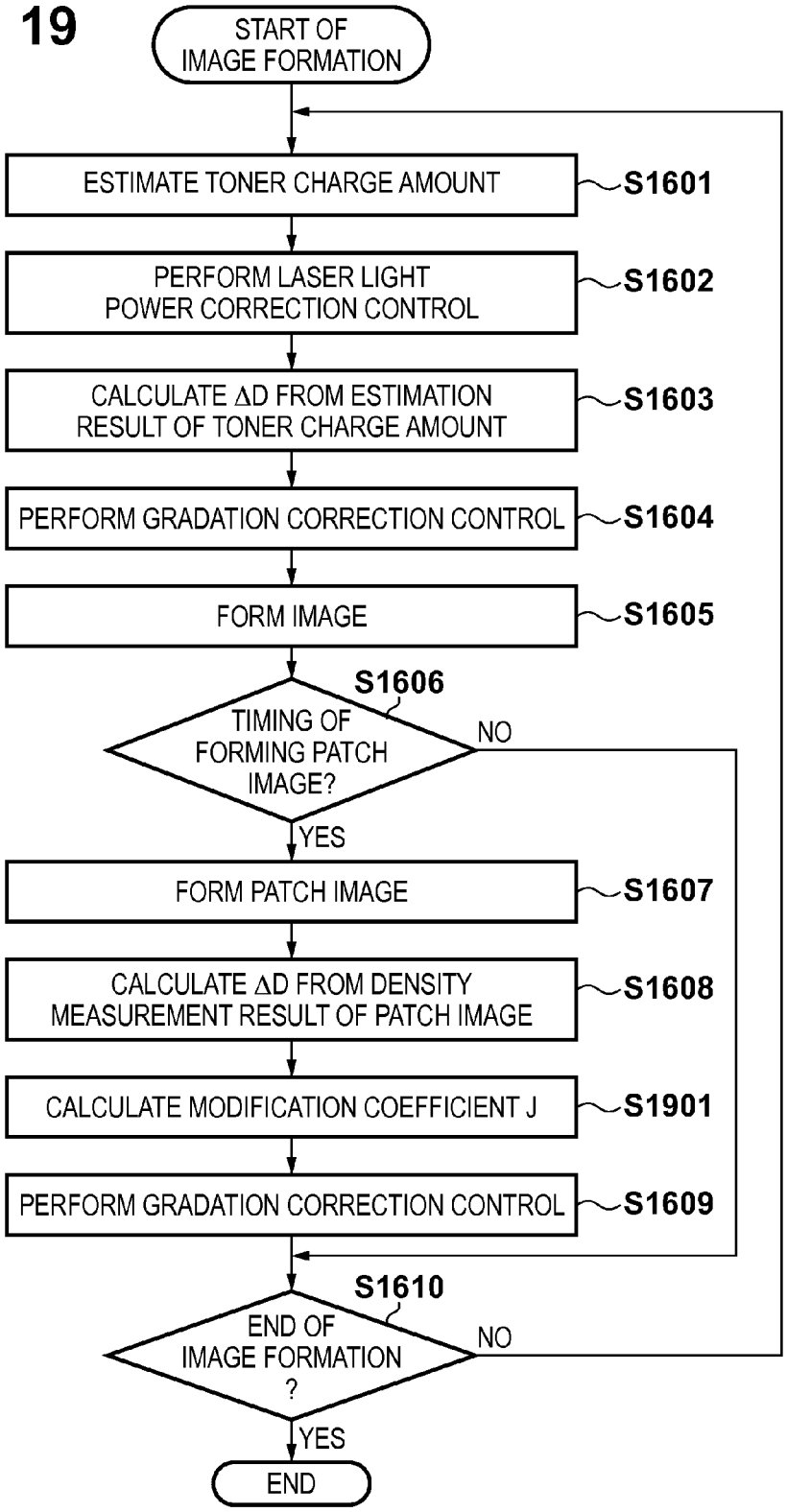
FIG. 19 is a flowchart showing steps of an image forming process including a laser light power correction control and a gradation correction control, in an image forming apparatus according to a second embodiment of the present invention.

Specifically, the modification coefficient J is calculated as a ratio of ΔD (ΔD_1) which is calculated in step S1608 of FIG. 16 and FIG. 19 described below to ΔD (ΔD_2) which is calculated most recently but prior to ΔD_1 in step S1603, according to the following expression:

$$J = \Delta D_1 / \Delta D_2 \quad (13)$$

By using the modification coefficient J, an error in ΔD which occurs, depending on Δtoner charge amount indicating a change in the average toner charge amount, can be corrected based on the most recent correction amount ΔD that is used for the gradation correction based on the patch image Q. As a result, the gradation correction control based on the result of estimation of the toner charge amount can be achieved with higher accuracy.

Next, steps of an image forming process including the above laser light power correction control and gradation correction control, in the image forming apparatus 100 of this embodiment, will be described with reference to FIG. 19. The steps of FIG. 19 are implemented by reading a control program stored in the ROM 113 to the RAM 112 and then executing the control program.

The second embodiment is different from the first embodiment (FIG. 16) in that, after step S1608, in step S1901 the CPU 111 calculates the modification coefficient J according to Expression (13). The modification coefficient J thus calculated is next used to calculate ΔD in step S1603 until the gradation correction control based on formation of the patch image Q is performed.

Figure 20:
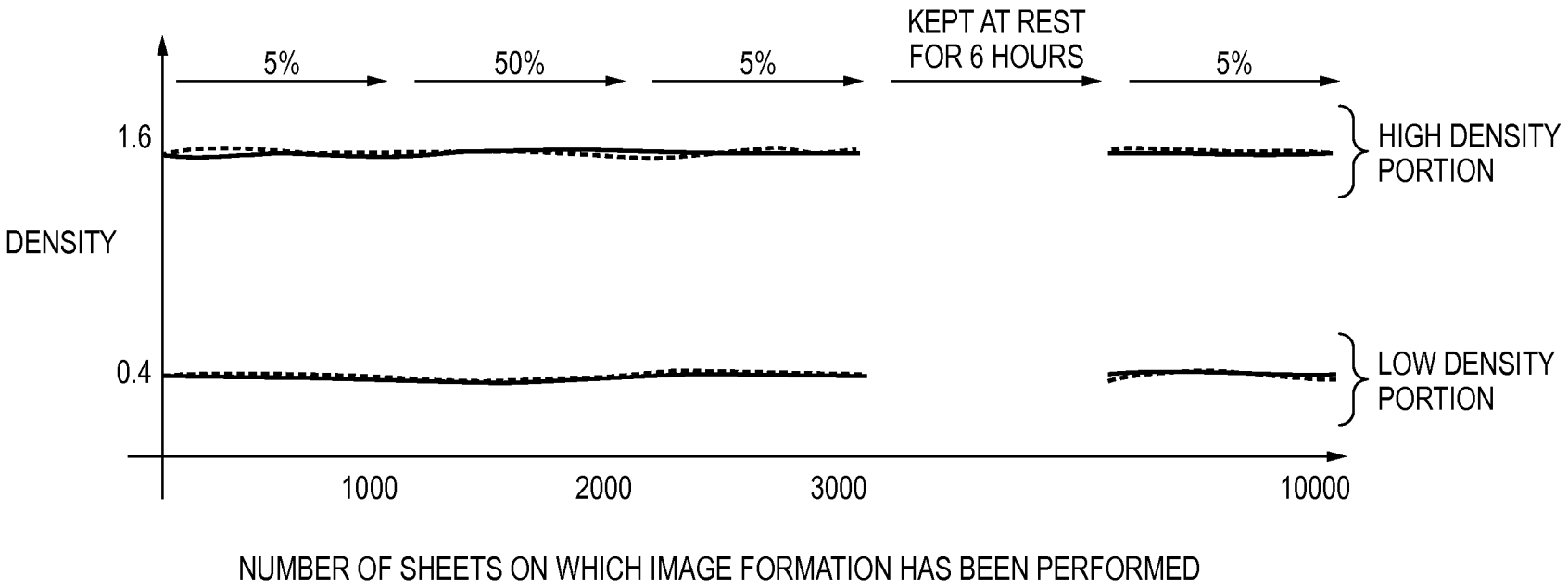
FIG. 20 is a diagram showing example changes in density characteristics with respect to the number of sheets on which image formation has been performed, in the image forming apparatus of the second embodiment of the present invention.

Next, FIG. 20 shows example changes in density characteristics with respect to the number of sheets on which image formation has been performed, when the result of estimation of the toner charge amount is used in the laser light power correction control and the gradation correction control (solid lines indicate this embodiment, and dashed lines indicate the first embodiment). Note that FIG. 20 shows characteristics under circumstances similar to those assumed in FIGS. 17 and 18 of the first embodiment.

As can be seen from FIG. 20, in this embodiment, the image forming apparatus 100 can perform image formation with more stable or consistent density characteristics than those of the first embodiment, irrespective of the level (density) of an input image signal, whereby a higher quality image can be formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2013-044712, filed Mar. 6, 2013, and 2013-044711, filed on Mar. 6, 2013, which are hereby incorporated by reference herein in their entirety.

What is claimed is:

1. An image forming apparatus comprising:

an image forming unit including an image carrier having a surface configured to be charged, an exposure unit configured to expose the image carrier with laser light based on an image signal to form an electrostatic latent image on the image carrier, and a development unit configured to develop the electrostatic latent image formed on the image carrier using toner;

a gradation correction unit configured to perform first gradation correction including forming a patch image on the image carrier using the image forming unit, and correcting gradation characteristics of the image formed by the image forming unit based on a correction amount corresponding to a result of measurement of the patch image;

a detection unit configured to detect or estimate a charge amount of toner possessed by the development unit; and a light power correction unit configured to perform light power correction including correcting light power of laser light emitted from the exposure unit, based on a difference between the toner charge amount detected or estimated by the detection unit and a reference value, wherein the gradation correction unit further performs second gradation correction including correcting the gradation characteristics based on a correction amount corresponding to the toner charge amount detected or estimated by the detection unit when the light power correction unit performs the light power correction.

2. The image forming apparatus according to claim 1, wherein the gradation correction unit includes a unit configured to calculate, as a modification coefficient, a ratio between the correction amount corresponding to the result of measurement of the patch image and a correction amount used in the second gradation correction which is previously performed, every time the first gradation correction has been performed, and when the second gradation correction is performed, the gradation correction unit corrects the gradation characteristics based on a correction amount obtained by using the modification coefficient to modify the correction amount corresponding to the toner charge amount detected or estimated by the detection unit.

3. The image forming apparatus according to claim 2, wherein the gradation correction unit uses, after having calculated the modification coefficient and until performing the next first gradation correction, the calculated modification coefficient in the second gradation correction.

4. The image forming apparatus according to claim 1, wherein the gradation correction unit performs the first gradation correction at an execution frequency lower than an execution frequency at which the light power correction is performed by the light power correction unit.

5. The image forming apparatus according to claim 4, wherein the light power correction unit performs the light power correction every time the image forming unit has performed image formation on one sheet of recording material, and the gradation correction unit performs the first gradation correction every time the image forming unit has performed image formation on a predetermined plurality of sheets of recording material.

6. The image forming apparatus according to claim 1, wherein the gradation correction unit, when performing the first gradation correction, causes the detection unit to detect or estimate the toner charge amount, and uses the toner charge amount detected or estimated by the detection unit as a reference value used for performing the second gradation correction.

7. The image forming apparatus according to claim 6, wherein the gradation correction unit, when performing the second gradation correction, corrects the gradation characteristics based on a correction amount corresponding to a difference between the reference value, and the correction amount corresponding to the toner charge amount detected or estimated by the detection unit when the light power correction unit performs the light power correction.

8. The image forming apparatus according to claim 1, further comprising:

a reading unit configured to read an image formed on a recording material, wherein, in response to a user's execution instruction, the gradation correction unit performs third gradation correction including causing the image forming unit to form a patch image on a recording material, and correcting the gradation characteristics based on a result of measurement of the patch image obtained by reading the recording material using the reading unit, and the light power correction unit, when the gradation correction unit performs the third gradation correction, causes the detection unit to detect or estimate the toner charge amount, and performs the light power correction using the detected or estimated toner charge amount as the reference value.

9. The image forming apparatus according to claim 1, wherein in the first gradation correction, the image forming unit forms a patch image having a predetermined low density on the image carrier.

* * * * *